US009217247B2

(12) United States Patent
Behling et al.

(10) Patent No.: US 9,217,247 B2
(45) Date of Patent: Dec. 22, 2015

(54) CEILING SYSTEM

(71) Applicant: Apple Inc., Cupertino, CA (US)

(72) Inventors: Stefan Behling, London (GB); David Nelson, London (GB); James McGrath, Cupertino, CA (US); Wolfgang Muller, London (GB); Lorenzo Poli, London (GB); Bernd Richter, Heubach (DE); Robert Bridger, Woodside, CA (US); Jonathan P. Siegel, San Francisco, CA (US); Vasco Agnoli, San Francisco, CA (US); Casey Feeney, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/175,756

(22) Filed: Feb. 7, 2014

(65) Prior Publication Data

US 2015/0225948 A1 Aug. 13, 2015

(51) Int. Cl.

| | |
|---|---|
| ***E04D 13/18*** | (2014.01) |
| ***E04H 14/00*** | (2006.01) |
| ***E04B 9/32*** | (2006.01) |
| ***F21V 5/04*** | (2006.01) |
| ***F21V 13/02*** | (2006.01) |
| *E04B 9/04* | (2006.01) |

(52) U.S. Cl.

CPC ... *E04B 9/32* (2013.01); *F21V 5/04* (2013.01); *F21V 13/02* (2013.01); *E04B 2009/0492* (2013.01)

(58) Field of Classification Search

CPC ..... F21V 5/04; F21V 13/02; E04B 9/32; E04B 2009/0492

USPC ..... 52/173.1

See application file for complete search history.

(56) References Cited

U.S. PATENT DOCUMENTS

| | | | | |
|---|---|---|---|---|
| 3,030,670 | A | 4/1962 | Bigelow | |
| 4,625,267 | A * | 11/1986 | Mikalonis | 362/150 |
| 5,282,331 | A * | 2/1994 | Fell | 40/617 |
| 5,620,369 | A * | 4/1997 | Spransy et al. | 454/187 |
| 6,351,920 | B1 * | 3/2002 | Hopkins et al. | 52/506.08 |
| 6,467,209 | B1 * | 10/2002 | Vickers | 40/617 |
| 2011/0175533 | A1 * | 7/2011 | Holman et al. | 315/130 |
| 2013/0070455 | A1 * | 3/2013 | Tsui et al. | 362/235 |

(Continued)

FOREIGN PATENT DOCUMENTS

| | | | |
|---|---|---|---|
| EP | 1 375 771 | A1 | 1/2004 |
| WO | WO 2005/073482 | A2 | 8/2005 |

OTHER PUBLICATIONS

Communication Relating to the Results of the Partial International Search. International Application No. PCT/US2015/014636, European Patent Office, mailed on May 19, 2015.

*Primary Examiner* — Mark Wendell

(74) *Attorney, Agent, or Firm* — Sterne, Kessler, Goldstein & Fox P.L.L.C.

(57) ABSTRACT

A ceiling system includes a support structure configured to be installed in a ceiling area of a variety of room types. A ceiling supported by the support structure may cover the majority of the ceiling area and may include light sources to light the room. The ceiling may be defined entirely by panels extending continuously from one end of the ceiling to an opposite end of the ceiling, arranged side-by-side with troughs in between. The panels may themselves be the light sources. Alternatively or additionally light sourced may be disposed within the troughs.

35 Claims, 29 Drawing Sheets

(56) References Cited

U.S. PATENT DOCUMENTS

2013/0301249 A1* 11/2013 Ngai et al. ..... 362/147
2014/0168954 A1* 6/2014 Gershaw ..... 362/147
2014/0313774 A1* 10/2014 Myers et al. ..... 362/612
2014/0313775 A1* 10/2014 Myers et al. ..... 362/612
2014/0313780 A1* 10/2014 Myers ..... 362/646

* cited by examiner

CEILING SYSTEM

FIELD

The described embodiments relate generally to a ceiling system. More particularly, the present embodiments relate to a lighted ceiling system that provides a consistent appearance and lights a room, for example, a retail store.

BACKGROUND

Ceilings in rooms are often areas in which light sources are located.

SUMMARY

Some embodiments of the present invention provide lighted ceiling panels and linear trough lights that emit an even light throughout their surface area, to evenly light the area above which they are installed. One or both of the lighted ceiling panels and linear trough lights can span an entire ceiling length to provide even light throughout an entire room.

Some embodiments of the present invention provide a number of panels disposed side-by-side in a ceiling area, spaced apart to form troughs therebetween. Together the panels and the troughs form a ceiling for a room. To maintain a consistent and aesthetically-pleasing look to the ceiling the panels may cover the majority of the ceiling, may each have the same width, and may be evenly spaced apart. The panels may present a clean visual appearance, and the troughs may provide a clear visual interruption between the panels.

Some embodiments of the present invention provide a ceiling system for a room, including a plurality of panels each having a length extending from one side of the room to an opposite side of the room. The panels may extend parallel to each other and may be spaced apart from each other to define a trough between adjacent panels. Each panel may include a panel frame and a continuous fabric cover tensioned over the frame and extending continuously along the length of the panel.

Some embodiments of the present invention provide an elongated light fixture including a frame having opposing vertically-arranged walls, a series of LEDs disposed on an interior side of each frame wall, a diffusing layer disposed between the frame walls, wherein the diffusing layer diffuses light from the LEDs, a backing layer disposed above the diffusing layer, wherein the backing layer reflects light from the LEDs, and a lens layer disposed below the diffusing layer, wherein light from the LEDs is emitted from the elongated light fixture through the lens layer.

Some embodiments of the present invention provide a ceiling system for a room including a plurality of longitudinal supports extending parallel to each other, wherein the longitudinal supports are disposed in a ceiling area of the room, a plurality of lighted panels extending parallel to each other and spaced apart from each other to define a trough between adjacent lighted panels, wherein each lighted panel is disposed between at least two of the longitudinal supports. Each lighted panel may include a panel frame coupled to the at least two longitudinal supports, a continuous fabric cover tensioned over the frame, and a lighting element disposed above the fabric cover. The ceiling system may also include a trough cover disposed within the trough, and a plurality of penetrations disposed within the trough and extending through openings in the trough cover.

Additional features of embodiments of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
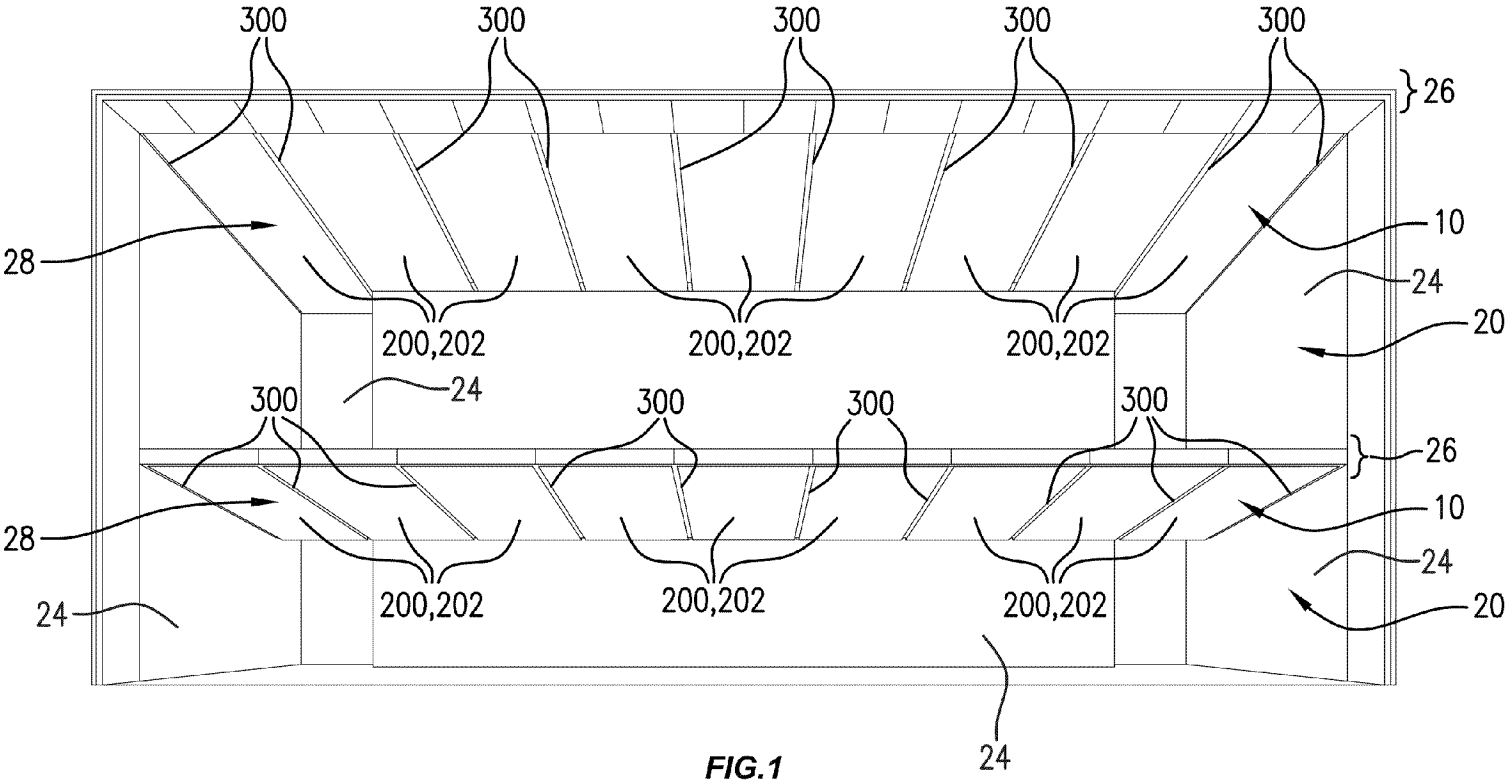
FIG. 1 illustrates a front perspective view of rooms including a ceiling system according to an embodiment presented herein.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

References to embodiments, such as "an embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

To illuminate a room, a light source may be attached to or integrated within a ceiling. In some cases, the light source may be a fixture hanging down from an area of the ceiling. In some cases, the light source may be positioned in a cut-out of a ceiling, or may take the place of a ceiling tile in a tiled ceiling. Such light sources may provide uneven lighting due to their discrete spaced-apart positioning with respect to the ceiling. For example, an area directly below a light source may be better-illuminated than one a distance away. Embodiments of the present invention provide lighted ceiling panels and linear trough lights that emit even light throughout their surface area, to evenly light the area above which they are installed. One or both of the lighted ceiling panels and linear trough lights can span an entire ceiling length to provide even light throughout an entire room. Such uniform lighting throughout a room provides consistent illumination of items within the room, regardless of their arrangement within the room. This can be ideal in a retail setting, where items and displays on the retail floor are subject to periodic change and reconfiguration. With uniform lighting throughout the room or an area thereof as provided by embodiments of the present invention, item and display configurations can be changed without regard to uneven lighting from discrete overhead light sources, since lighting throughout the area will uniformly illuminate throughout the area. In a retail environment this minimizes potential trade-offs between floor position and illumination level, and minimizes the potential need to reconfigure a room's lighting in order to optimize illumination of a new item or display configuration on the retail floor.

Lighting design for a room can be subject to a variety of requirements. For example, lighting must fit into the room structure (whether existing or newly fabricated), and may be designed so that its illumination conveys a desired character, meets regulatory requirements, and illuminates features of a room. Since rooms can be different, lighting systems may have to be custom-designed for a room to achieve consistent illumination across different rooms. Embodiments of the present invention provide a lighting system that is built upon a support structure that is adaptable to a wide variety of room shapes and configurations, while still providing consistent illumination.

Installations of the ceiling system of embodiments of the present invention may use one or more sub-systems as deemed necessary or expedient for the installation. The sub-systems may include, for example, (1) a panel sub-system that may include relatively wide lighted or non-lighted panels, (2) a trough sub-system that may include discrete lights within relatively narrow inverted troughs, and (3) a linear trough light sub-system that may include continuous light elements within relatively narrow inverted troughs. These sub-systems may be used separately or together in combination on the same support structure to suit the parameters of any installation. For example, the trough sub-system and/or linear trough light sub-system may be disposed between adjacent panels of the panel sub-system. In some embodiments the trough sub-system and linear trough light sub-system may include discrete utilities penetrating through the trough area to provide additional functionality to the ceiling system, such as, for example, cameras, additional lights, sprinklers, smoke detectors, and audio speakers. The wide configurability and functionality of the sub-systems of the ceiling system of embodiments of the present invention can be adapted to a wide variety of rooms and uses, while still providing a consistent look, illumination, and utilities between installations.

Figure 2:
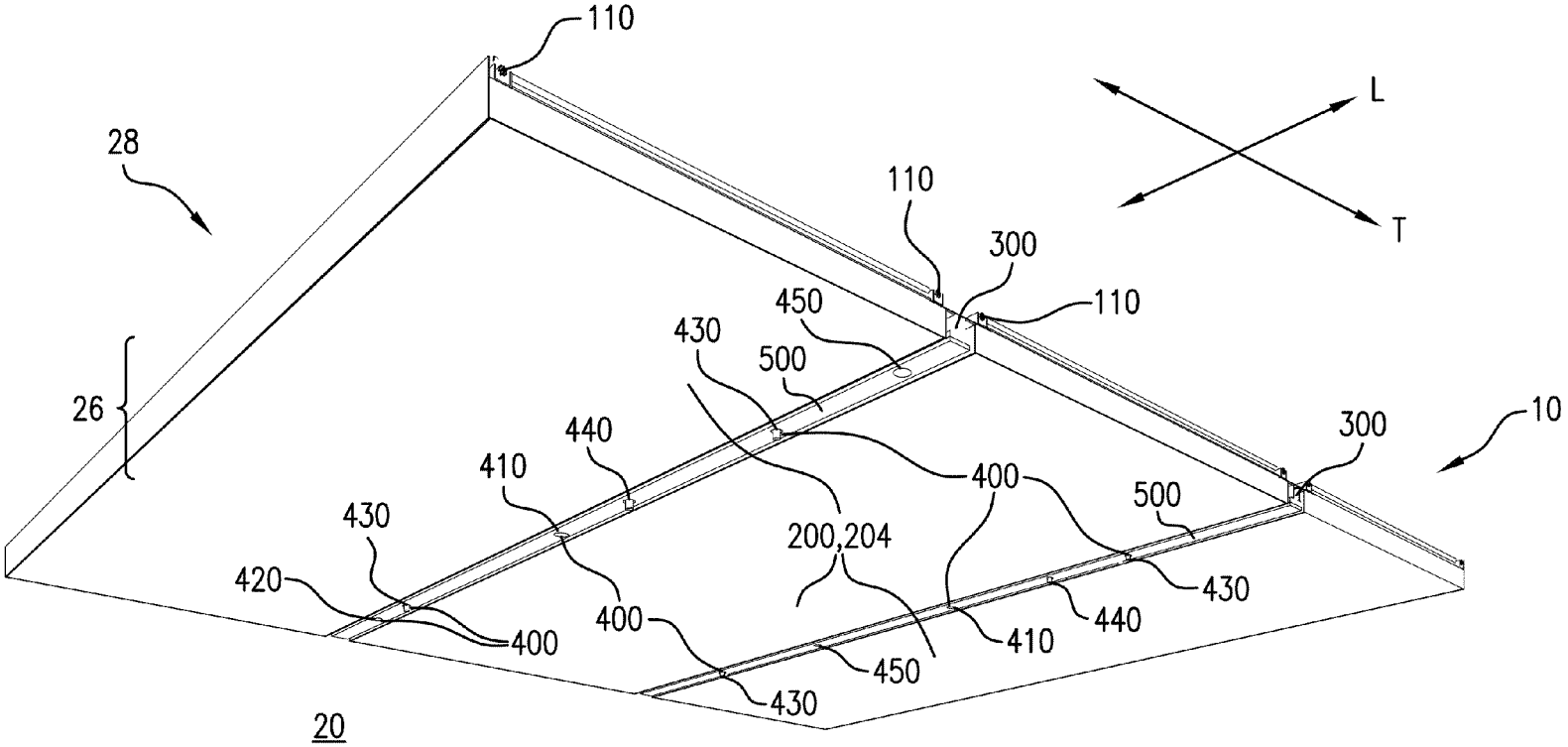
FIG. 2 illustrates a perspective view of a ceiling system according to an embodiment presented herein.

In some embodiments of the present invention, a room 20 may be illuminated by light sources of a ceiling system 10, which may be positioned in a ceiling area 26 of room 20. Ceiling system 10 may include panels 200 positioned parallel (or perpendicular) to each other and extending across a length of ceiling area 26. Ceiling system 10 may also define troughs 300 between adjacent panels. Exemplary configurations are shown in FIGS. 1 and 2. In some embodiments, panels 200 may be lighted panels 202, in which case they may act as light sources to illuminate room 20 (see FIG. 1). In some embodiments panels 200 may be non-lighted panels 204 (see FIG. 2). In some embodiments an elongated light fixture such as linear trough light 500 is disposed within trough 300 (see FIG. 2). Linear trough light 500 may act as a light source to illuminate room 20. In some embodiments troughs 300 may include penetrations 400 therein. Penetrations 400 may be devices providing various functionality. For example, a penetration 400 may be a light fixture such as a downlight 410 (e.g., an LED (light emitting diode) light within a reflective cavity configured to direct light out from the cavity), which may act as a light source to illuminate room 20. Other penetrations 400 may include a camera 420, a sprinkler 430, a smoke detector 440, and a speaker 450 (see, e.g., FIGS. 2-4). In some embodiments, drivers and other controls for penetrations 400 may be located remotely therefrom (e.g., in an access panel), to facilitate remote operation and maintenance.

In some embodiments, penetrations 400 may generate heat due to their operation. Penetrations 400 may be affixed to transverse struts 120 using a connector that acts as a heat sink, directing heat away from penetration 400 and dissipating it throughout support structure 100.

Different rooms 20 may have different characteristics. For example, structural support elements (e.g., ceiling subsurface or other structural supporting elements such as beams, joists, or purlins) of one room may be in different locations or may be more or less abundant than structural support elements in another room. Such structural support elements of a ceiling area 26 may be used to support ceiling system 10, so their positions, structure, and abundance may influence how ceiling system 10 can be supported.

Figure 3:
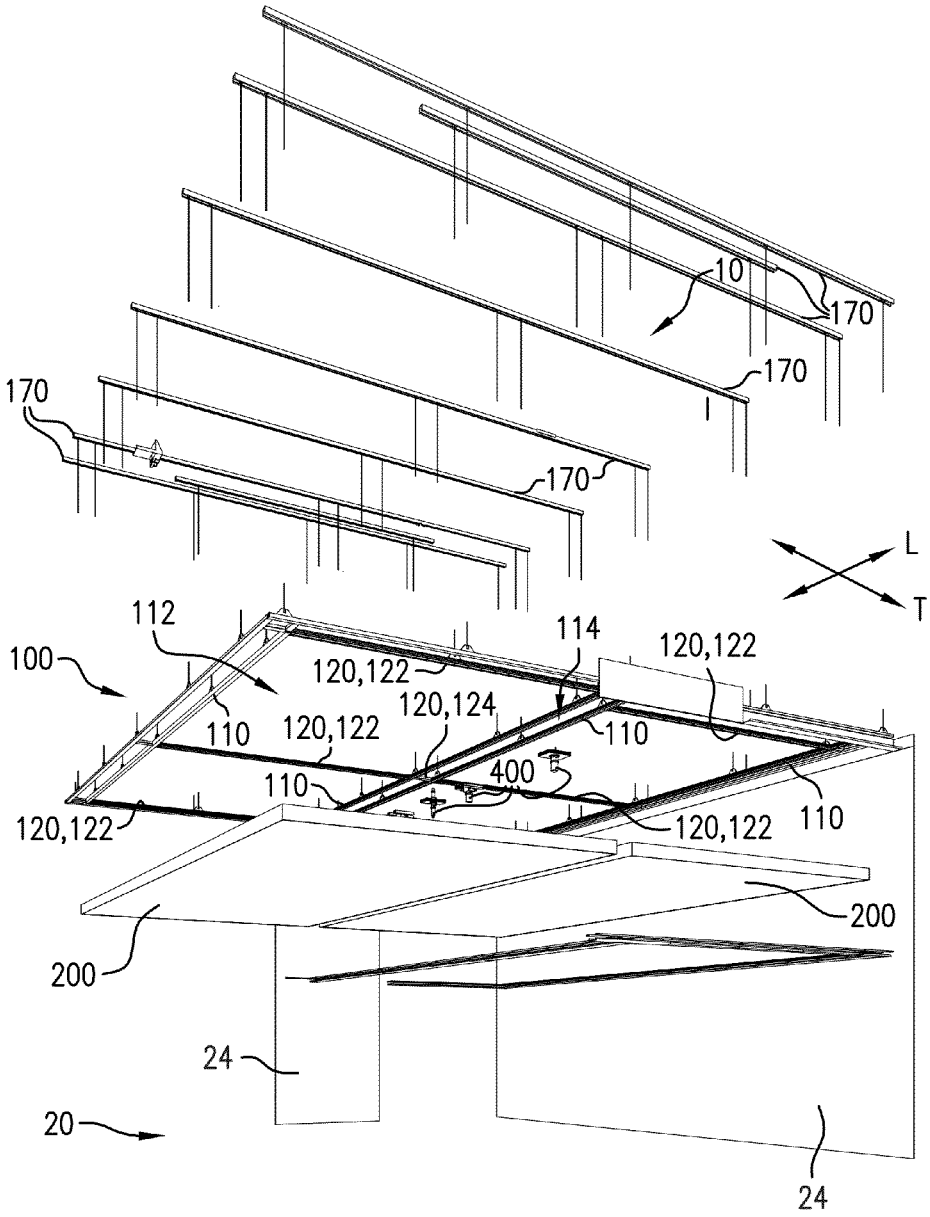
FIG. 3 illustrates an exploded perspective view of a ceiling system according to an embodiment presented herein.
Figure 4:
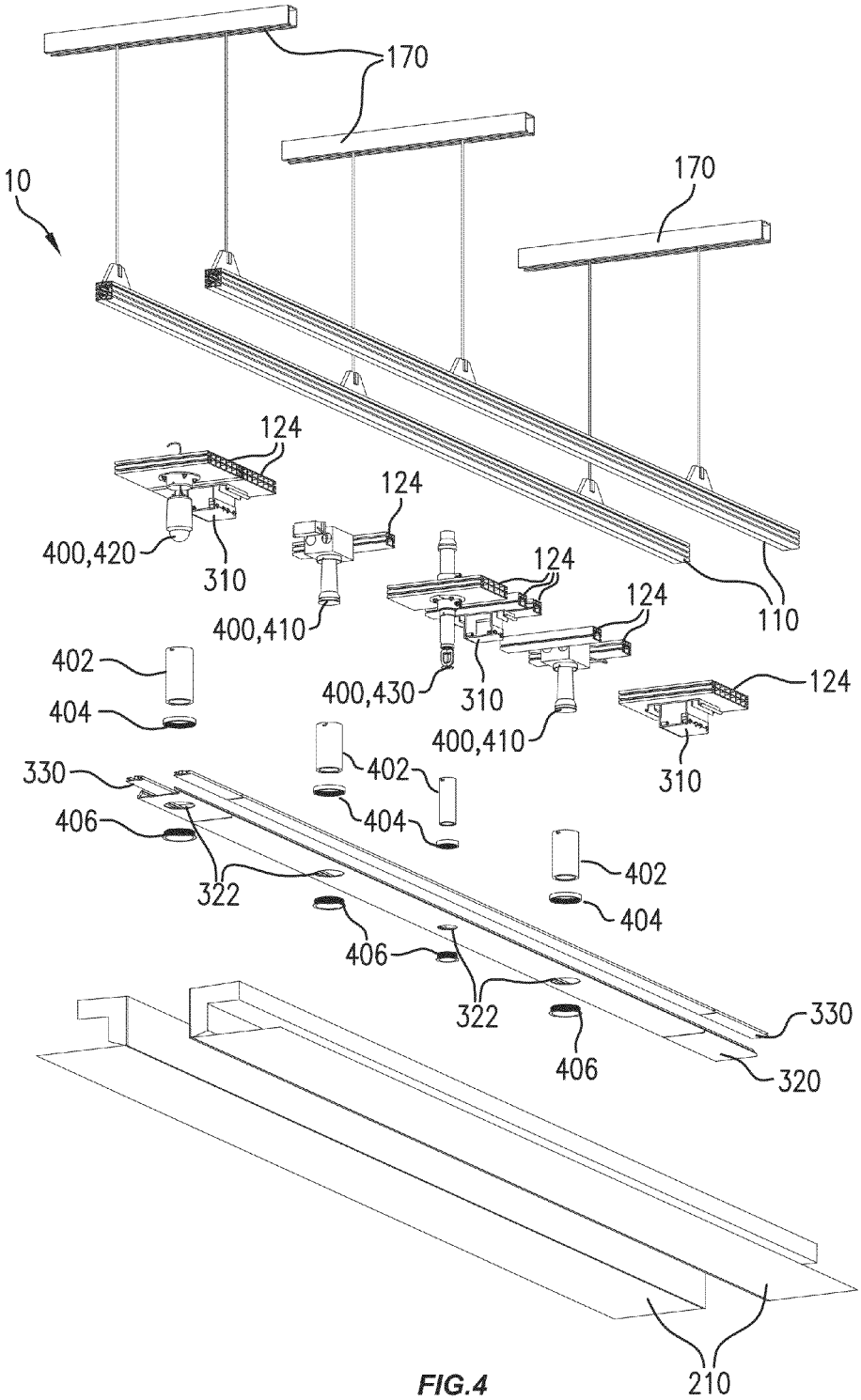
FIG. 4 illustrates an exploded perspective view of a ceiling system according to an embodiment presented herein.

In order to provide a consistent structural basis for panels 200 and troughs 300, a support structure 100 of ceiling system 10 may include transversely-spaced longitudinal supports 110 extending in a longitudinal direction L (see FIGS. 2-4). Longitudinal supports 110 may be continuous support beams hung from structural support elements of room 20 and extending longitudinally across room 20. To achieve a desired spacing, longitudinal supports 110 may be hung from structural support elements via intermediate transverse supports 170 extending in a transverse direction T. Transverse supports 170 may be support beams hung from or otherwise affixed to structural support elements of ceiling area 26 of room 20 and may extend transversely across room 20. Longitudinal supports 110 may attach to transverse supports 170 (e.g., via a cable and attachment mechanism) at any positions along the lengths of transverse supports 170, and so longitudinal supports 110 can be positioned as desired within room 20, including any desired transverse spacing. In this way, panels 200 and troughs 300 can be arranged in any desired manner to suit any room 20, without requiring extensive re-designing of a ceiling system to suit different characteristics of different rooms.

Longitudinal supports 110 may be spaced to define a panel area 112 and a trough area 114, as shown, for example, in FIG. 3. Panel areas 112 and trough areas 114 may alternate across ceiling system 10. Panel areas 112 may be of similar width in order to present a consistent appearance. In some embodiments, panel areas 112 may all be similar width except for panel areas 112 at ends of ceiling system 10, which may be narrower or wider than the rest of panel areas 112 of ceiling system 10. This can allow for flexibility in aligning panel areas 112 within ceiling area 26, while maintaining a consistent appearance. Trough areas 114 may also be of similar width in order to present a consistent appearance. The width of trough areas 114 may be less than the width of panel areas 112. Exemplary appearances that can be achieved with ceiling systems according to the present invention are disclosed in U.S. Design Pat. Application No. 29/481,231, filed Feb. 3, 2014, titled "Building," and in U.S. Design Pat. Application No. 29/481,634, filed Feb. 7, 2014, titled "Light System." Each of these applications is incorporated herein in its entirety by reference thereto.

To effect their relative widths, the distance between longitudinal supports 110 separated by a panel area 112 may be larger than the distance between longitudinal supports 110 separated by a trough area. For example, the distance between longitudinal supports 110 separated by a panel area may be 8 to 12 feet (e.g., 10 feet), and the distance between longitudinal supports 110 separated by a trough area may be 8 to 12 inches (e.g., 10 inches).

Panels 200 may occupy panel area 114, and troughs 300 may occupy trough area 114. Since panels 200 extend between longitudinal supports 110, the ability to freely position longitudinal supports 110 (as described above) helps to effect desired positioning of panels 200 and troughs 300, to achieve a desired appearance of ceiling system 10 and desired light characteristics from ceiling system 10.

Support structure 100 may include transverse struts 120 fixed to and extending between adjacent longitudinal supports 110. Transverse struts 120 may help maintain the relative positions of adjacent longitudinal supports 110 with respect to each other. Panel area transverse struts 122 may extend within panel areas 112, and trough area transverse struts 124 may extend within trough areas 114.

A number of panels 200 may be disposed side-by-side in ceiling area 26, spaced apart to form troughs 300 therebetween (see FIGS. 1 and 2). Together panels 200 and troughs 300 form a ceiling 28 for room 20, thereby defining an upper boundary of room 20. To maintain a consistent and aesthetically-pleasing look to ceiling 28, panels 200 may cover the majority of ceiling area 26 (e.g., may extend wall-to-wall across ceiling area 26 in one or both of a transverse and longitudinal direction), may each have the same width (with the possible exception of panels on the ends of ceiling 28 adjacent a wall, which may be wider or narrower to fit the available space), and may be evenly spaced apart. Panels 200 may be a light color, for example, white, to present a clean visual appearance and for consistency with light produced by light sources of ceiling system 10. Troughs 300 may provide a clear visual interruption between panels 200. To contrast with panels 200, troughs 300 may be a dark color, for example black.

Since panels 200 and elements of trough 300 are retained within ceiling area 26 by attachment to longitudinal supports 110, the ability to position longitudinal supports 110 as desired (described above) helps to effect the desired appearance of ceiling 28 by allowing panels 200 and troughs 300 to be arranged as desired. In some embodiments, to conform to a ceiling area 26 or to provide an angled look, ceiling 28 may be angled. In other words, one end of each panel 200 may be higher than its opposite end. Ceiling 28 can be angled longitudinally, transversely, or both. Angling ceiling 28 longitudinally may make room 20 appear larger or smaller, by influencing a viewer's perspective of the room in that direction. Angling ceiling 28 longitudinally may also help ceiling 28 to conform to an angled ceiling area 26, where, for example, a floor above ceiling area 26 is cantilevered over room 20.

In some embodiments, ceiling 28 may extend to walls 24 of room 20, to cover an entire ceiling area 26 of room 20 (see FIG. 1). In some embodiments, ceiling 28 may cover the majority of ceiling area 26. In such embodiments, a perimeter of ceiling 26 may be spaced apart from walls by a distance that is less than the length of a panel 200, no greater than 5% of the length of a panel, less than a width of a panel, no greater than 10% of the width of a panel, equal to the width of the space between adjacent panels, less than the width of the space between adjacent panels, no greater than 16 inches, or within the range of 3 inches to 16 inches.

The bottom surface of panels 200 may be defined by a cover material 250, which may be a flexible sheet material 252 such as plastic or fabric. Sheet material 252 may extend continuously (i.e., as a single continuous piece of fabric, without seams or other interruptions) over the entirety of a frame 210 of panel 200, to create a uniform, continuous look to ceiling 28. Since fabric (or other materials used for flexible sheet material 252) is flexible, its use to form the bottom surface of panel 200 contributes to the high configurability of panels 200. Frame 210 can be constructed to a desired size, and fabric 252 can be cut to size and applied to frame 210. This helps minimize the need to design and build specialized parts to install a consistent-looking ceiling system across a variety of different rooms.

In some embodiments, panel 200 (and thus continuous fabric 252) can be formed on a large scale. For example, having a width of at least 5 feet and a length of at least 32 feet. In some embodiments, a length of panel 200 is at least 500% of its width. For example, in some embodiments ceiling panels 200 are spaced apart 10 feet on center, with a 4 to 6 inch gap for trough 300, thereby resulting in a panel width of 9 feet, 8 inches. In other embodiments ceiling panel 200 may have a width of 7 feet. Generally, a wider ceiling panel 200 (e.g., greater than 8 feet) may be used for a lighted panel 202, while a narrower ceiling panel 200 (e.g., less than 8 feet) may be used for a non-lighted panel 204.

Also for example, in some embodiments, ceiling panel 200 and continuous fabric 252 have lengths of 40 feet, 50 feet, 60 feet, 70 feet, 80 feet, 90 feet, or 120 feet. Each trough 300 may have a length corresponding at least to the shortest panel 200 it is adjacent to. Troughs 300 may have a width substantially smaller than the width of panels 200. For example, each trough 300 may have a width less than 5% of the width of an adjacent panel 200. In some embodiments, each trough has a width less than 10% of the width of an adjacent panel 200.

Figure 5:
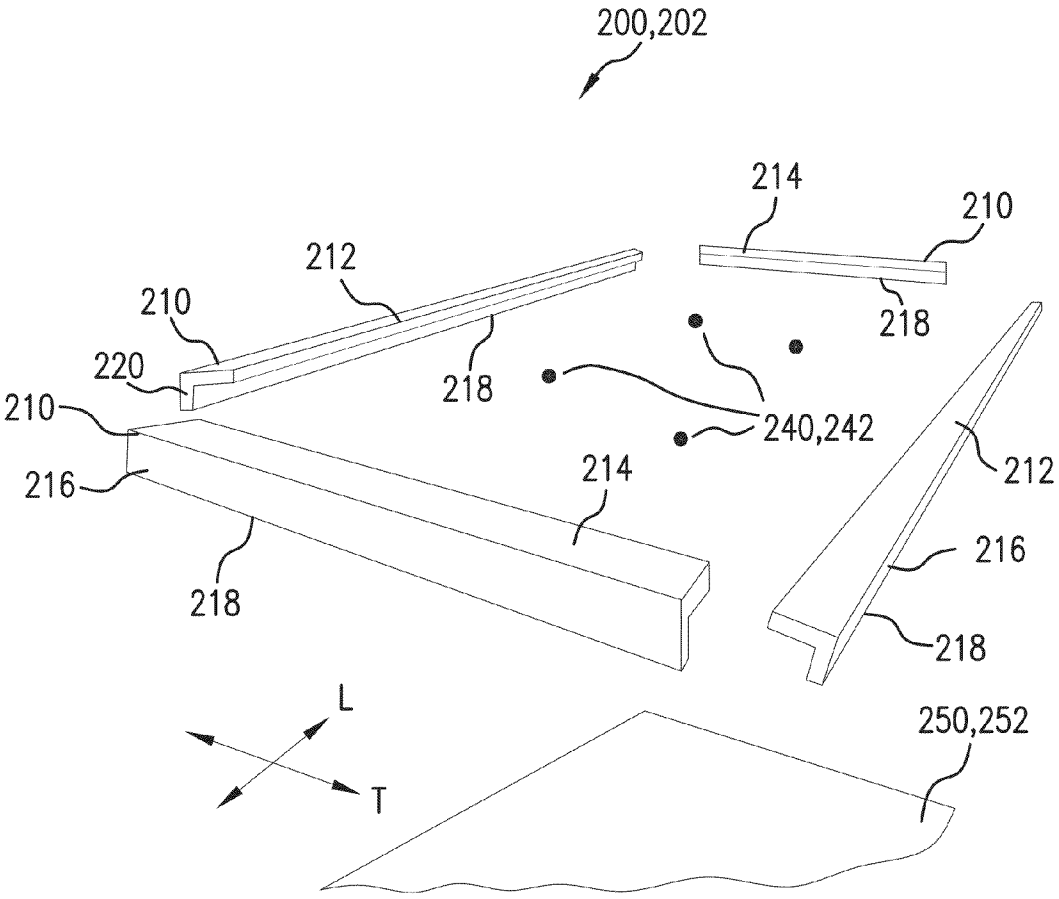
FIG. 5 illustrates an exploded perspective view of a portion of a panel according to an embodiment presented herein.

In some embodiments, panels 200 may be mounted to longitudinal supports 110. Each panel 200 may include a frame 210 that provides structure to its perimeter, as shown, for example, in FIG. 5, which shows an exploded view of an exemplary panel 200 Each panel 200 may also include cover material 250 spanning the area bounded by frame 210 and extending over and wrapping around the bottom edges of frame 210. In this way, cover material 250 defines a bottom of panel 200. In some embodiments, where panel 200 is a lighted panel 202, lighted panel 202 may include a light source 240 disposed above cover material 250. In embodiments where panel 200 is a non-lighted panel 204, non-lighted panel 202 includes no internal light source.

Frame 210 may be rectangular, and may include short frame elements 214 extending transversely at ends of panel 200, and long frame elements 212 extending longitudinally along sides of panel 200. In some embodiments, frame 210 (and thus panel 200) may be non-rectangular in shape. For example, frame 210 may be trapezoidal or may be wedge-shaped (optionally with a curve at the front and rear ends). Also for example, frame 210 (and thus panel 200) may define a notch therein, to accommodate, for example, structural elements of room 20 such as the upper portion of a support column. Frames 210 (and thus panels 200) may be configured to fit around and into all portions of a ceiling area 26 to provide full coverage of ceiling area 26 so that ceiling 28 is defined consistently throughout by panels 200 and troughs 300.

In some embodiments, cover material 250 may be a fabric 252 that is tensioned across frame 210. Fabric 252 may wrap around bottom edges 218 of frame 210 and may engage with a tensioning mechanism of frame 210 that may accept and retain portions of fabric 252 so that fabric 252 covers the bottom area defined by frame 210. In this way, fabric 252 hides internal elements of panel 200 to present a consistent visual appearance.

Tensioning fabric 252 over frame 210 minimizes the possibility of wrinkles, bulges, or other non-visually-uniform configurations of fabric 252. In some embodiments, fabric 252 is placed into tension before being affixed to frame 210. In this case, a tensioning mechanism of frame 210 may help maintain the tensioned character of fabric 252. For example, the tensioning mechanism may include a mechanical fastener or adhesive that locks fabric 252 in position relative to frame 210.

Figure 7:
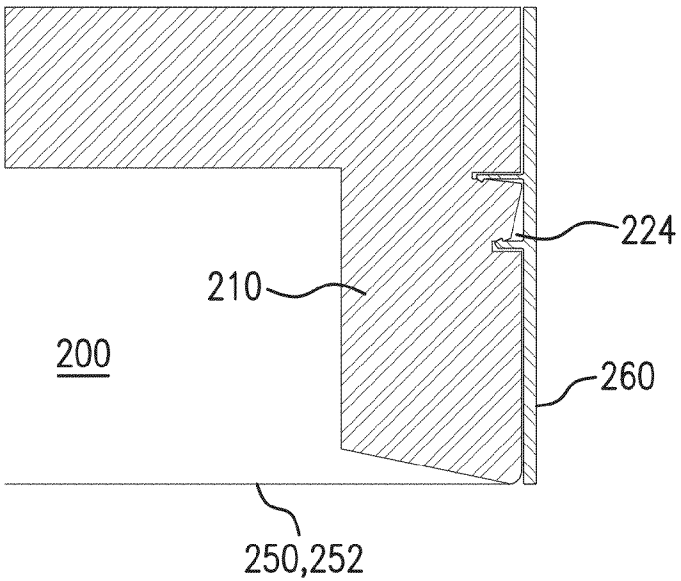
FIG. 7 illustrates a cross-sectional longitudinal view of a portion of a panel according to an embodiment presented herein.
Figure 6:
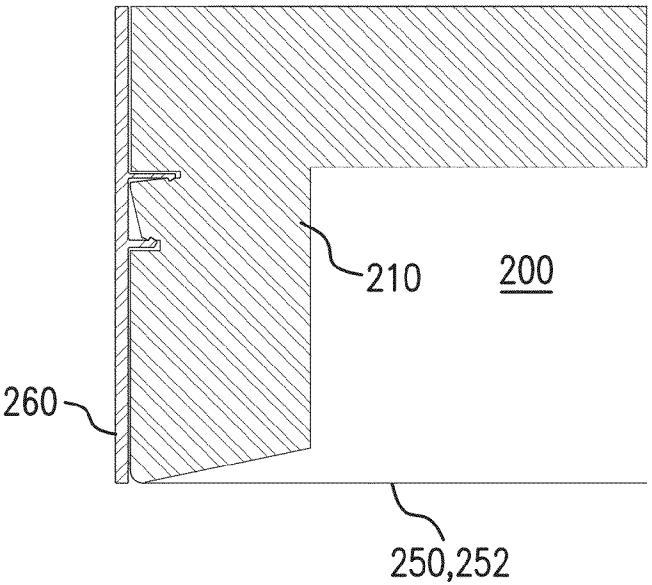
FIG. 6 illustrates a cross-sectional longitudinal view of a portion of a panel according to an embodiment presented herein.

In some embodiments, side covers 260 may be disposed over outer side 216 of frame 210, to hide frame 210 and to help present a consistent and continuous look for trough 300 (the sides of which may be defined by side covers 260 of adjacent spaced-apart panels 200). Side covers 260 may be affixed to frame 210 in any suitable manner, for example, by an attachment mechanism 224 such as a snap-fit, as shown in FIGS. 6 and 7. Side cover 260 may be unornamented on its outer side, and may extend across the height of panels 200, to present a consistent look to the sides of panels 200.

In embodiments where panel 200 is a lighted panel 202, a light source 240 may be disposed above cover material 250. To produce a uniform light character throughout lighted panel 202, light source 240 may include LEDs longitudinally and transversely spaced apart throughout lighted panel 202. In some embodiments, light source 240 may emit light upward toward a backing disposed above light source 240. The backing may reflect and diffuse the light downward through cover material 250, to illuminate room 20 below. Reflecting and diffusing the light may promote a consistent light character through cover material 250, and may help minimize the appearance of bright spots due to the individual light elements (e.g., LEDs) of light source 240.

In some embodiments, fabric 252 may meet desired functional, aesthetic, and safety goals. For example, to achieve a consistent light quality through fabric 252, fabric 252 may have consistent characteristics throughout, including thickness, weave density, and color. Also for example, to fit securely to frame 210 in tension, fabric 252 may be elastic such that when it is stretched in tension, it tends toward its original shape. Such elasticity will help fabric 252 maintain an even and unwrinkled surface of panel 200. In the case of a woven fabric 252, fabric 252 may include elastic fibers to impart elasticity to fabric 252. In the case of a knitted fabric 252, elasticity may be imparted to fabric 252 by the form of knit used, by the incorporation of elastic fibers into fabric 252, or both.

Also for example, to achieve a consistent aesthetic look, fabric 252 may be free of visual defects and may have consistent coloring throughout. For example, fabric 252 may be white. White panels 200 may contrast with black troughs 300 to provide a clean, ordered aesthetic appearance to ceiling 28. White fabric 252 may also help to achieve the desired light characteristics through fabric 252 (e.g., soft, natural light). To achieve desired safety characteristics, fabric 252 may be fireproof, in that it will not burn if subjected to flame (e.g., class A international fire-rated).

To achieve these and other goals, fabric 252 may be an industrial glass fiber fabric such as glass cloth. Glass fiber is not combustible.

As noted above, fabric 252 may be formed in large sizes (e.g., 32 feet, 40 feet, 50 feet, 60 feet, 70 feet, 80 feet, or 90 feet). To achieve such large sizes while maintaining the desired functional, aesthetic, and safety qualities of fabric 252, fabric 252 may be formed continuously over the desired length and width, without seams or interruptions.

Troughs 300 separate adjacent panels 200, and thus extend the same lengths as the panels 200 they are adjacent to (or at least the length of the shorter of two adjacent panels 200, in the event that adjacent panels 200 have different lengths). Elements of troughs 300 are supported by longitudinal supports 110 and trough area transverse struts 124 that extend therebetween (see, e.g., FIG. 8, which shows a cross-sectional perspective view of trough 300).

Figure 8:
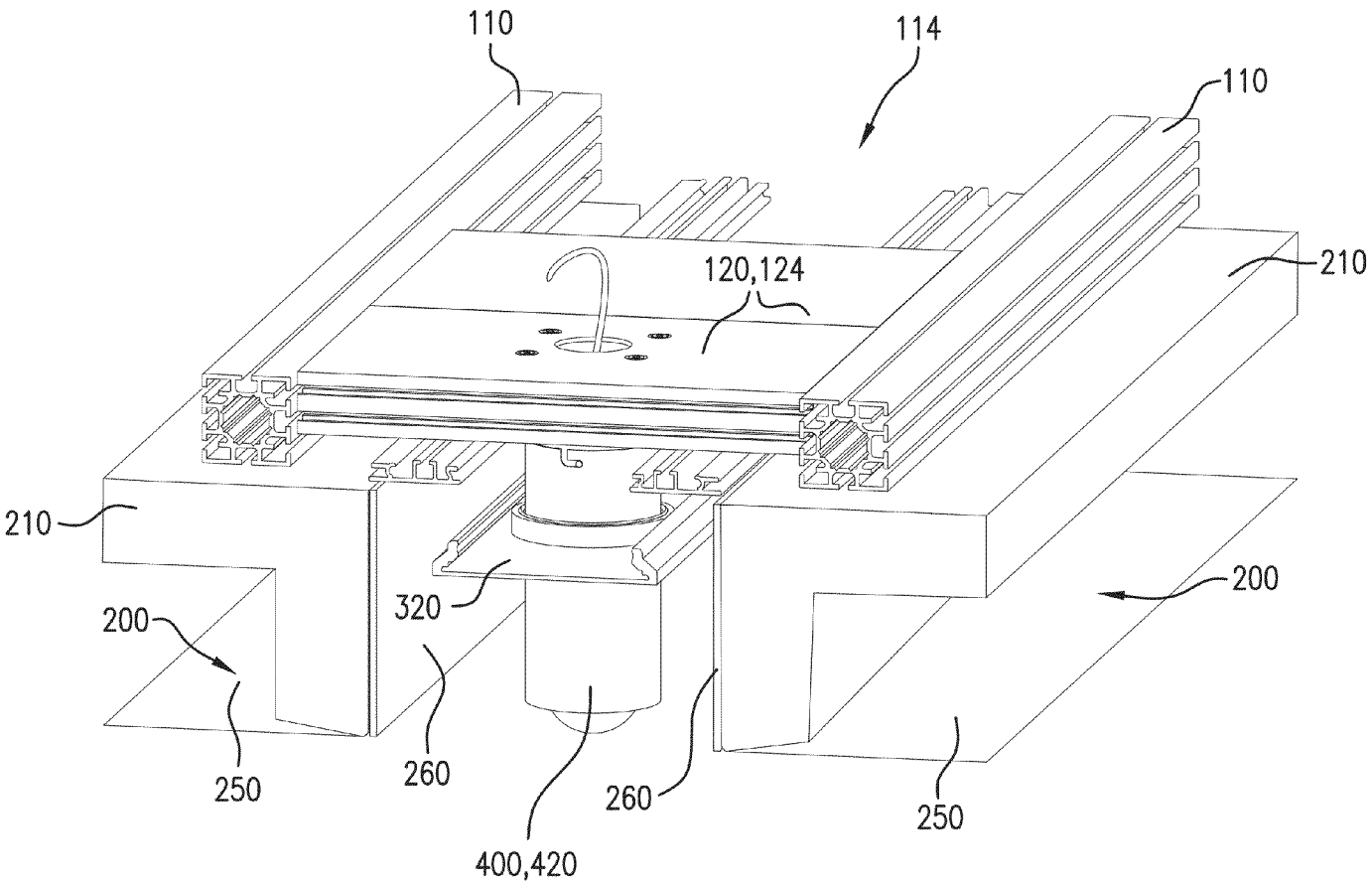
FIG. 8 illustrates a perspective view of a section of a trough including a camera according to an embodiment presented herein.

Trough area transverse struts 124 may support trough elements such as, for example, penetrations 400. Positioning penetrations 400 within trough area 114 helps minimize their visual impact within ceiling system 10, while maintaining their functionality. FIG. 4 shows an exploded perspective view of penetrations 400 within trough area 114. FIG. 8 shows a perspective view of camera 420. Penetrations 400 other than camera 420 may be configured similarly. In FIGS. 4 and 8 (and in other figures as will be apparent throughout) only the portions of panels 200 immediately adjacent trough 300 are shown, for clarity.

In some embodiments, T-bars 310 are disposed within trough area 114. Each T-bar 310 may be coupled to a trough area transverse strut 124, as shown in FIGS. 4 and 8. Multiple T-bars 310 may be positioned in the same trough 300, longitudinally spaced apart from each other. For example, a T-bar 310 may be positioned every 5 feet within trough 300. Each T-bar 310 may have a top flange 314 and a bottom bracket 316. Top flange 314 may be secured to a transverse strut 124 by any suitable attachment mechanism such as, for example, screws. Top flange 314 may have a pair of opposing wings 315 protruding beyond sides of bottom bracket 316 for attaching upper covers 330 to T-bar 310. Bottom bracket 316 may have a hollow rectangular cross-section (see, e.g., FIG. 9), and may include a cover attachment mechanism 312 for attaching a central cover 320 to T-bar 310.

Central cover 320, upper covers 330, and side covers 260 (of panels 200, discussed above) define trough 300 and help maintain a consistent look of trough 300 by hiding internal structure of ceiling system 10. For consistency in appearance, all covers 320, 330, and 260 may be the same color (e.g., black), and may have a flat, unornamented surface facing the inner area of trough 300. To achieve the same color covers 320, 330, and 260 may be painted or anodized.

Figure 9:
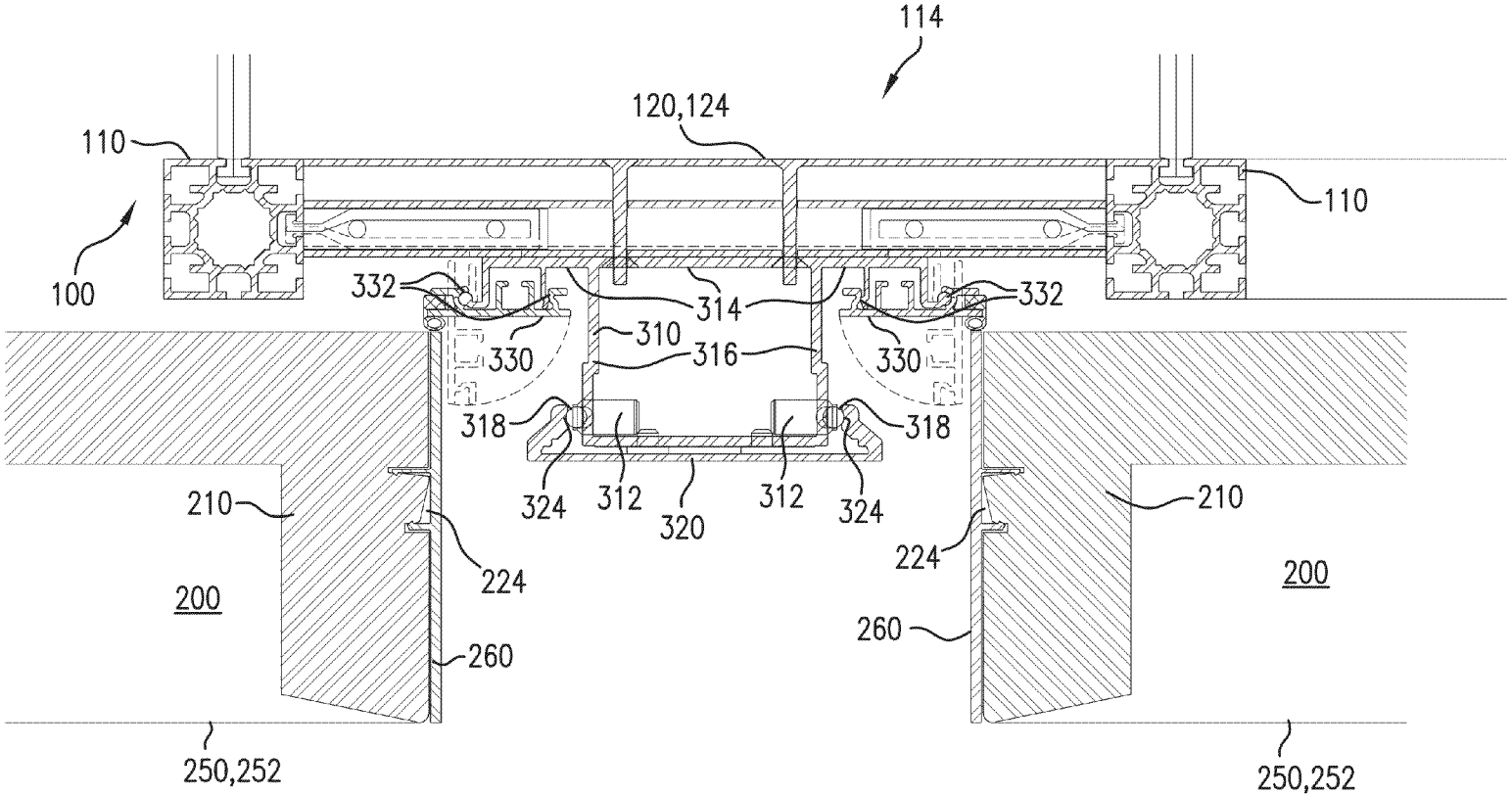
FIG. 9 illustrates a cross-sectional longitudinal view of a trough according to an embodiment presented herein.
Figure 10:
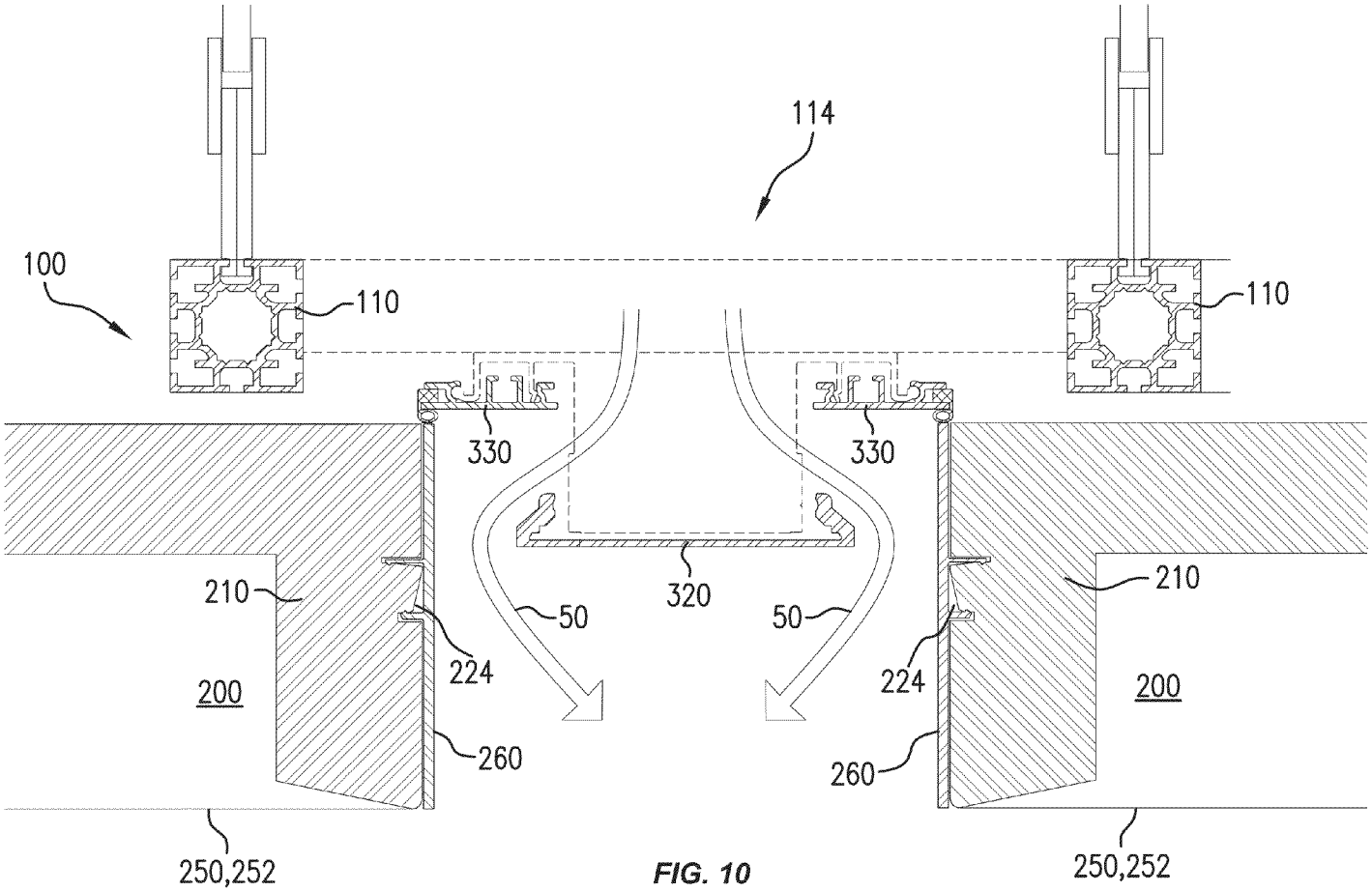
FIG. 10 illustrates a cross-sectional longitudinal view of a trough according to an embodiment presented herein.

Central cover 320 is attached to and extends between T-bars 310 via attachment mechanisms 312. FIG. 9 shows a cross-sectional view of trough 300 taken through a T-bar 310. FIG. 10 shows a cross-sectional view of trough 300 taken between T-bars 310. In some embodiments, attachment mechanisms 312 include spring-loaded ball bearings 318 that protrude out from lower sides of bottom bracket 316 and snap into channels 324 of central cover 320 when central cover 320 is forced upward against T-bars 310. The spring forces on ball bearings 318 of attachment mechanisms 312 holds ball bearings 318 within channels 324, thereby retaining central cover 320 in place against T-bars 310. In this way, central cover 320 can be securely retained to central cover 320 in normal use, but can also be easily removed to provide access through trough 300. To minimize the visual impact of central cover 320, central cover 320 may be recessed from a bottom surface of panels 200, as shown in FIGS. 6 and 7.

The arrangement of T-bars 310, central cover 320, and upper covers 330 allow for airflow through trough 300 without providing a visually-apparent airway or duct. As shown in FIG. 10, air 50 can easily pass through trough 300 by travelling between upper covers 330 and around central cover 320.

Upper covers 330 are attached to and extend between T-bars 310 via attachment mechanisms 332. In some embodiments, attachment mechanisms 332 include a hinged detent fit between top flange 314 of T-bar 310 and upper cover 330. The hinged detent fit, when engaged, may maintain upper cover 330 in a horizontal position to hide elements above it from view. When the hinged detent fit is disengaged, upper cover 330 may rotate about a longitudinal axis while still being retained within trough 300 (see FIG. 9, where the rotated position of upper cover 330 is shown in phantom lines). In this way, upper covers 330 can be securely retained within trough 300, but can also be easily moved to the sides of trough 300 to provide wider access through trough 300.

Figure 11:
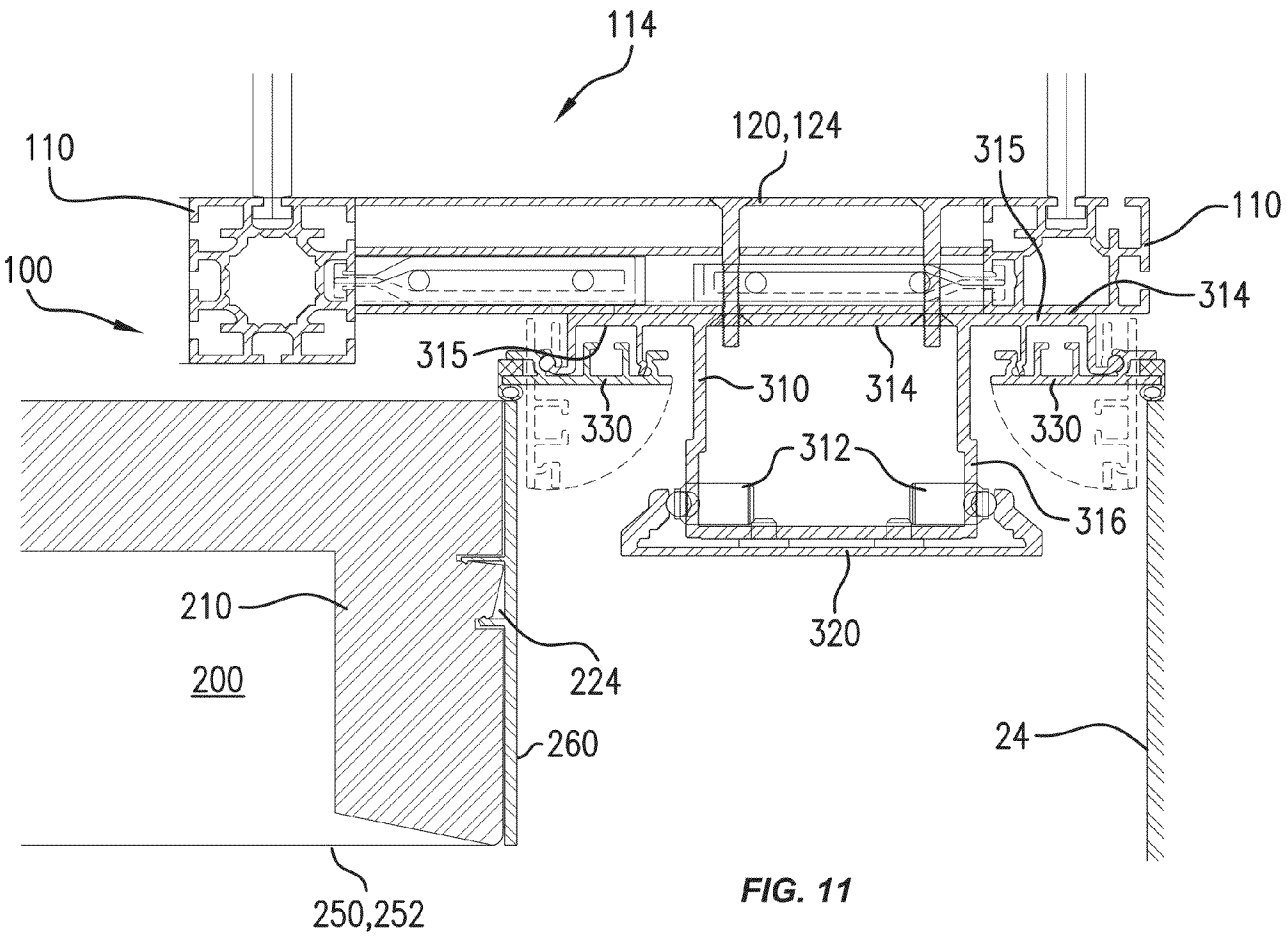
FIG. 11 illustrates a cross-sectional longitudinal view of a trough according to an embodiment presented herein.
Figure 12:
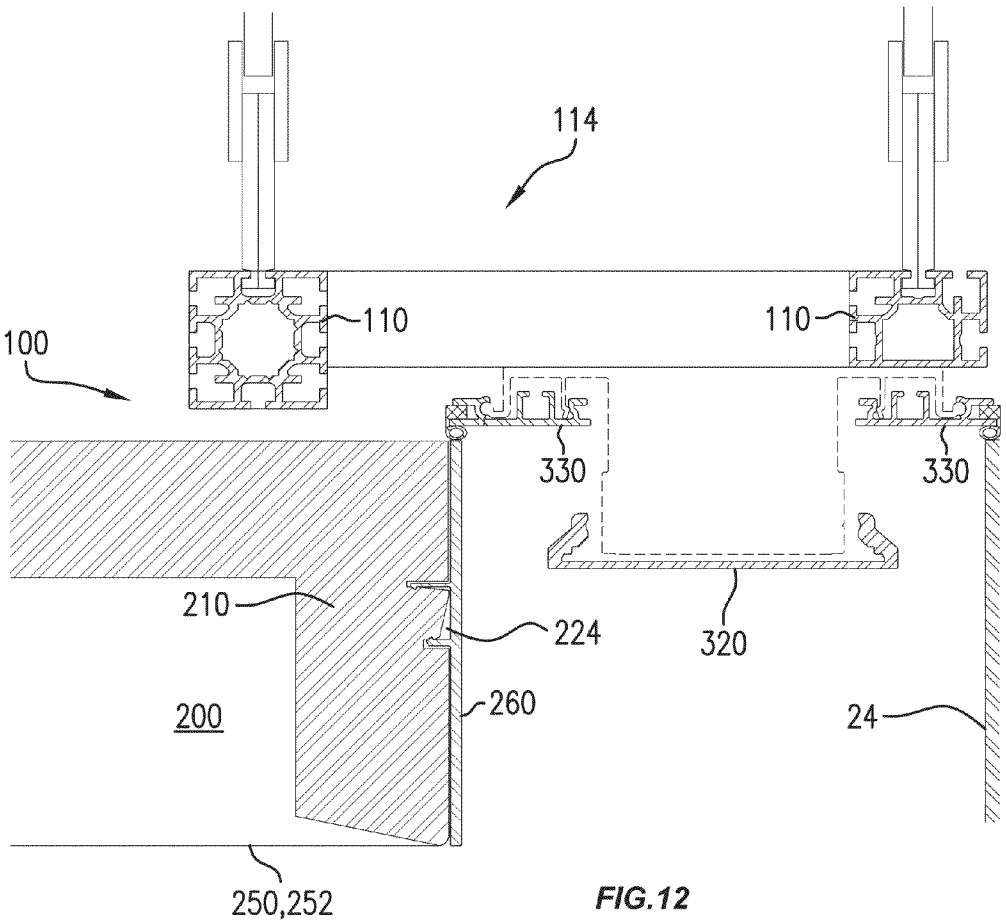
FIG. 12 illustrates a cross-sectional longitudinal view of a trough according to an embodiment presented herein.

Troughs 300 at peripheral sides of ceiling 28 may be adjacent only one panel 200. In this case, on the side opposite panel 200 there may simply be an empty space, or a wall 24 of room 20, as shown in FIGS. 11 and 12. FIG. 11 shows a cross-sectional view of such an end trough 300 taken through a T-bar 310. FIG. 12 shows a cross-sectional view of such an end trough 300 taken between T-bars 310.

Figure 13:
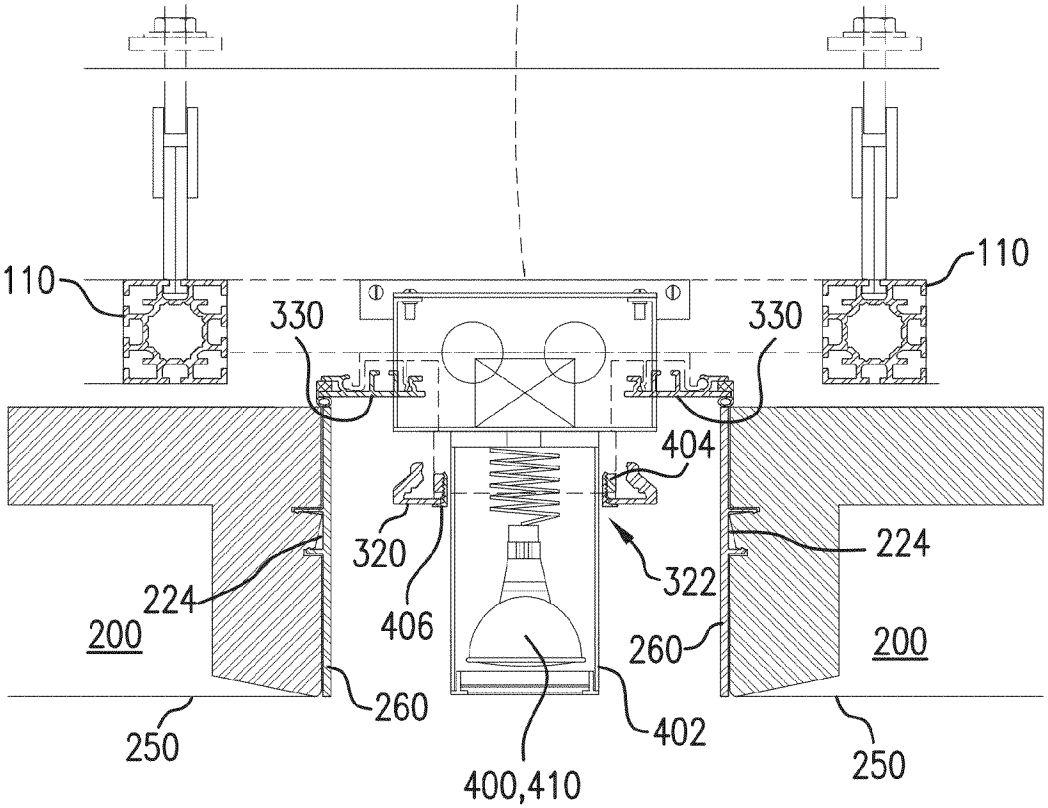
FIG. 13 illustrates a cross-sectional longitudinal view of a trough and downlight according to an embodiment presented herein.
Figure 14:
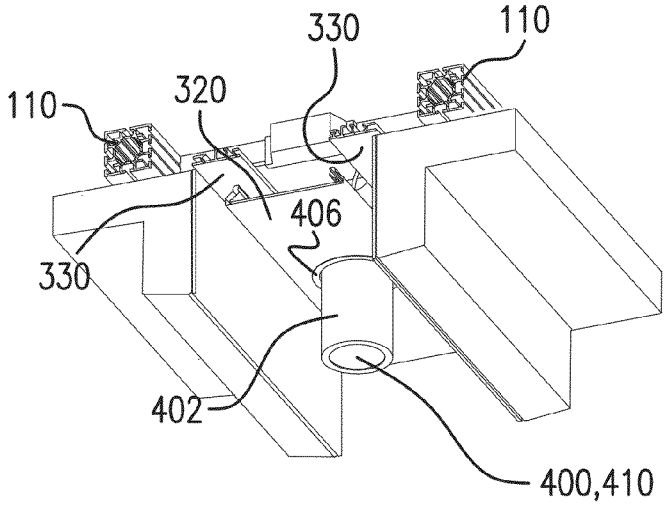
FIG. 14 illustrates a perspective view of a section of a trough including a downlight according to an embodiment presented herein.
Figure 15:
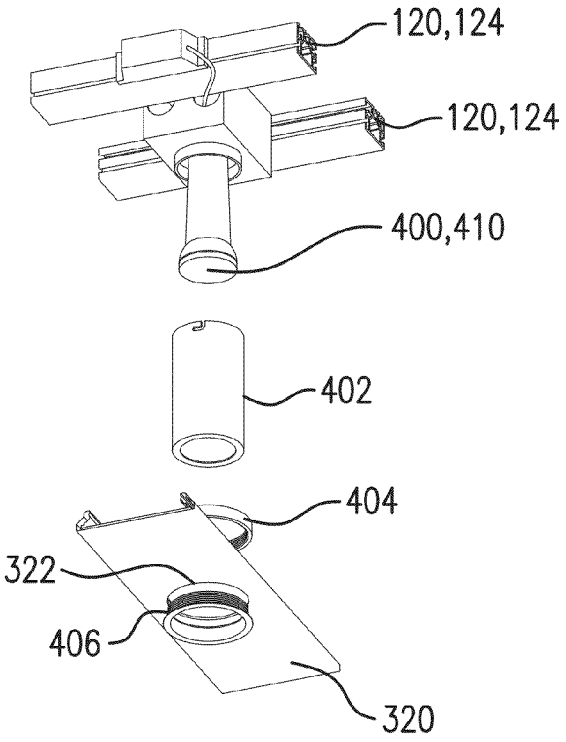
FIG. 15 illustrates an exploded perspective view of a downlight within a trough according to an embodiment presented herein.

To effectively provide their respective functionalities, penetrations 400 may extend through openings 322 in central cover 310. FIGS. 13-15 show downlight 410 extending through an opening 322 of central cover 310. Other penetrations 400 may be configured similarly. In some embodiments, multiple types of penetrations 400 may have the same diameter or width, to be able to penetrate through the same size openings 322. In some embodiments multiple openings 322 may have the same diameter, and multiple types of penetrations 400 may have a diameter or width less than the diameter of openings 322. Allowing multiple types of penetrations 400 to fit within similarly-sized openings 322 can increase the configurability of trough 300.

Figure 16:
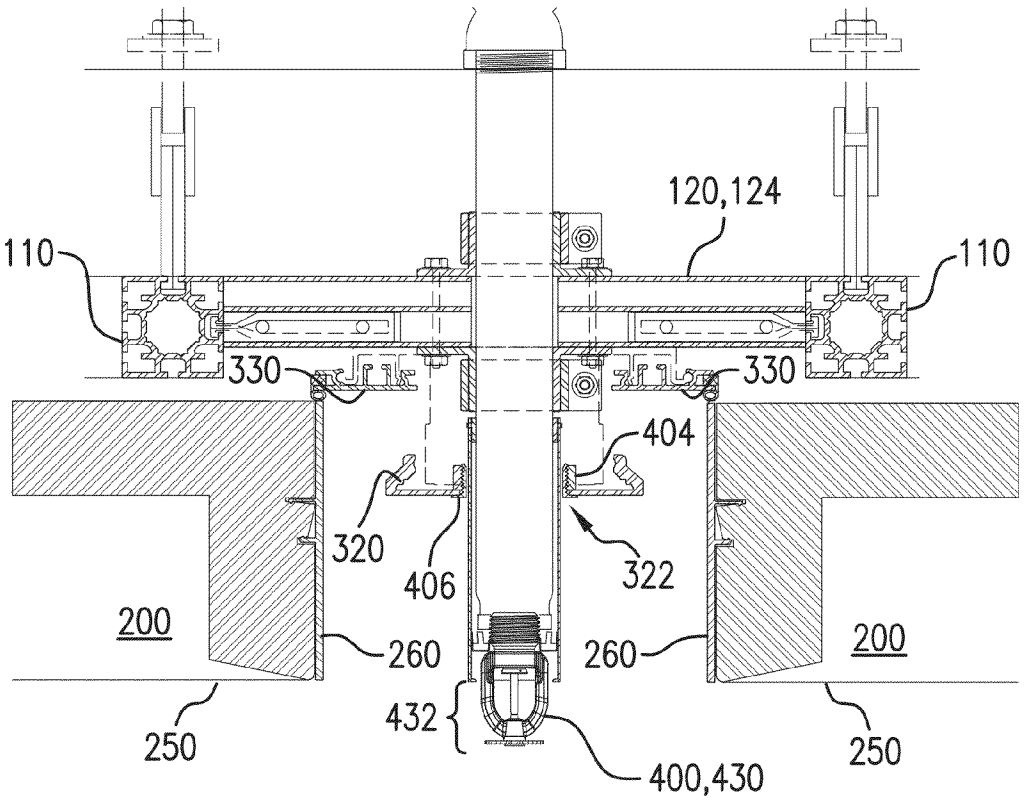
FIG. 16 illustrates a cross-sectional longitudinal view of a trough including a sprinkler according to an embodiment presented herein.
Figure 17:
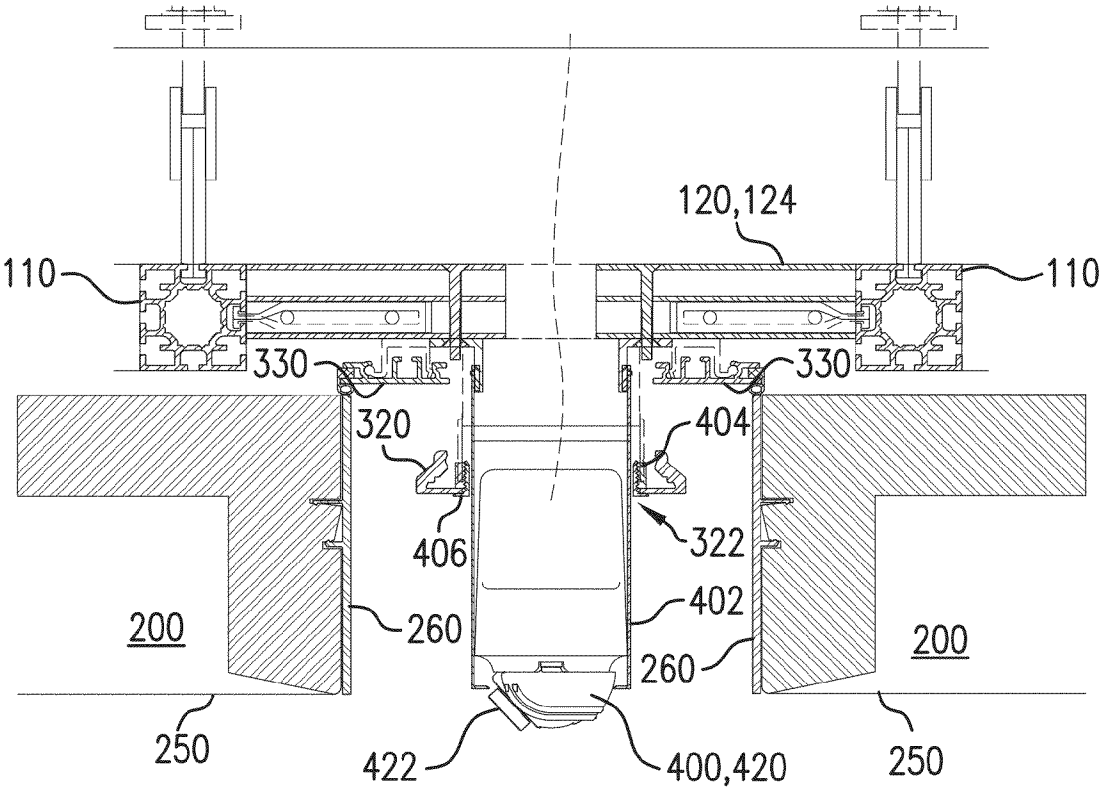
FIG. 17 illustrates a cross-sectional longitudinal view of a trough including a camera according to an embodiment presented herein.

Penetrations 400 may extend beyond central cover 320 by any desired distance. For example, downlight 410 may extend to a bottom surface of panels 200, in order to present a consistent visual impression and, in the case of lighted panels 202, a consistent plane of light sources. Some penetrations 400 may not extend as far as the bottom surface of panels 200, and some may extend beyond the bottom surface of panels 200. For example, to minimize its visual impact, smoke detector 440 may not extend to the bottom surface of panels 200, since it can effectively perform its function while remaining recessed therefrom. Also for example, camera 420 and sprinkler 430 may extend below the bottom surface of panels 200, so that panels 200 do not interfere with their functions (see, e.g., FIGS. 16 and 17). In the case of penetrations 400 that extend below the bottom surface of panels 200, they may extend below the bottom surface of panels 200 only to the extent needed to effectively perform their functions, in order to minimize their visual impact. For example, as shown in FIG. 16 only the sprinkler head 432 of sprinkler 430 may protrude below the bottom surface of panel 200, and as shown in FIG. 17 only the camera lens 422 of camera 420 protrudes below the bottom surface of panel 200.

To maintain visual consistency with other elements within trough 300, penetrations 400 may be disposed within a penetration sleeve 402. Penetration sleeve 402 may protect and hide the internal structure of its penetration 400. Penetration sleeve 402 may extend through central cover 320 at an opening 322 thereof. Opening 322 may be fitted with a fixing ring 404 and escutcheon 406 to provide a clean passageway for penetration sleeve 402 and to hide edges of central cover 320 around opening 322.

A bottom edge or surface of penetration sleeve 402 may extend to and align with the bottom surface of panels 200, in order to present a consistent visual impression. In some embodiments, penetration sleeve 402 may be colored the same color as central cover 310 (e.g., black), so that visually the sides of penetrations 400 blend in with central cover 310 to minimize their visual impression within trough 300. In some embodiments, central cover 310, upper covers 320, side covers 260, and penetration sleeves 402 are the same color (e.g., black), so that trough 300 presents a consistent visual impression throughout its length, with minimal obvious visual interruption or distraction.

Figure 20:
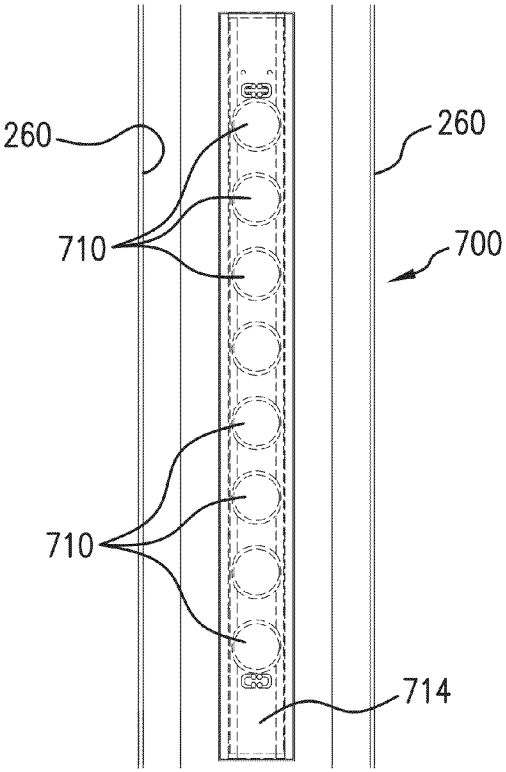
FIG. 20 illustrates a bottom view of a section of a trough including a speaker according to an embodiment presented herein.
Figure 18:
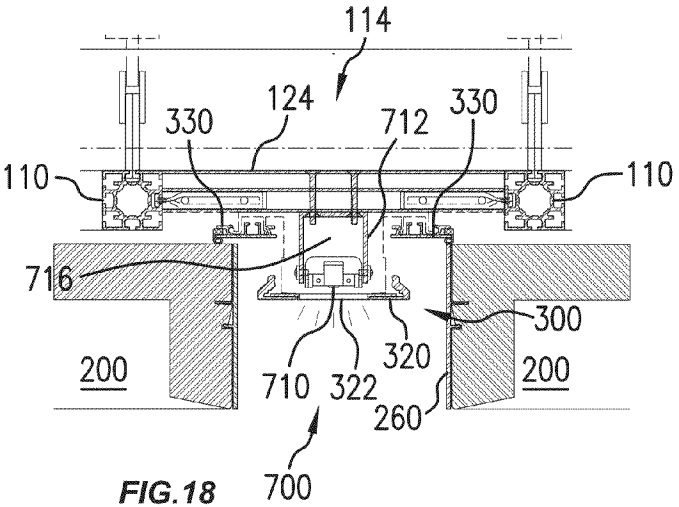
FIG. 18 illustrates a cross-sectional longitudinal view of a trough including a speaker according to an embodiment presented herein.
Figure 19:
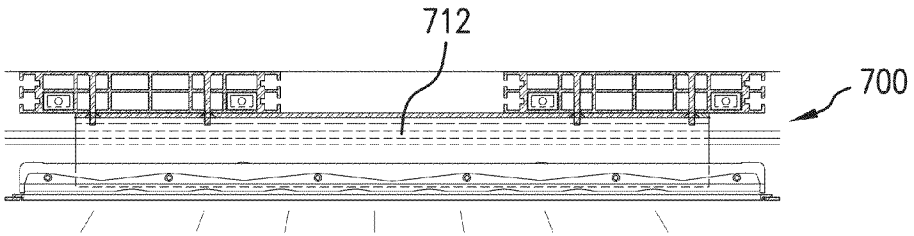
FIG. 19 illustrates a cross-sectional transverse view of a section of a trough including a speaker according to an embodiment presented herein.

In some embodiments, audio equipment may be incorporated into ceiling system 10, to provide audio signals (e.g., alarms, music, or voice) while hiding the audio equipment from view and while maintaining high sound quality. To avoid interference with sound by panels 200 (e.g., muffling of sound waves as they pass through panels 200), and to avoid interfering with light produced by panels 200, speakers 710 of a trough audio system 700 may be positioned within trough area 114 (e.g., directly in trough 300, see FIGS. 18-20). To provide even sound within the narrow confines of trough 300, a series of speakers 710 (e.g., 3 speakers 710) may be disposed in a row along trough 300 and may have a sound chamber 716 behind them to direct sound downward. In some embodiments, speakers 710 are no more than 4 inches wide, to effectively fit within trough 300. In some embodiments, speakers 710 are coupled to a speaker cover 714 that is configured to interrupt and take the place of central cover 320. In such embodiments, speakers 710 can be attached to T-bar 310 in the same manner as central cover 320.

In some embodiments, speakers 710 are retained above openings 322 in central cover 320 by a speaker bracket 712. In some embodiments speakers 710 are securely anchored to trough area transverse struts 124. In some embodiments, speakers 710 avoid direct contact with other elements (such as central cover 320) in to avoid sound degradation (e.g., buzz due to vibrations from contacting other elements) and provide optimum sound output from trough 300 to room 20.

Figure 21:
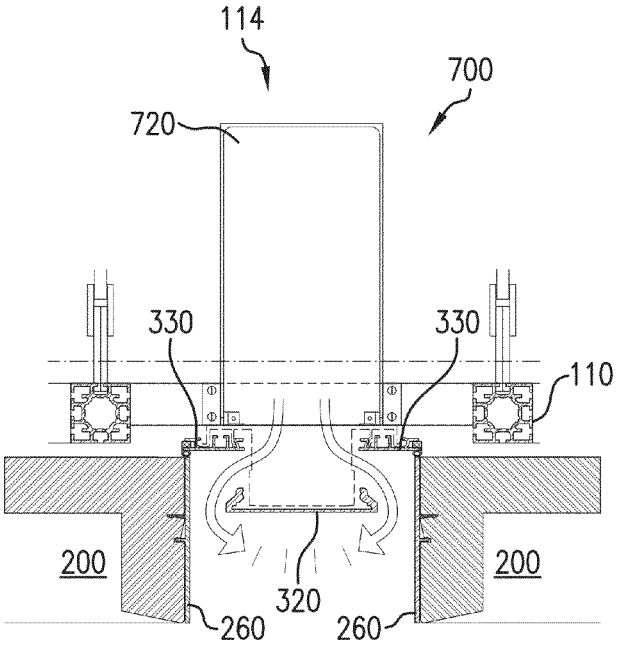
FIG. 21 illustrates a cross-sectional longitudinal view of a trough including a subwoofer according to an embodiment presented herein.
Figure 22:
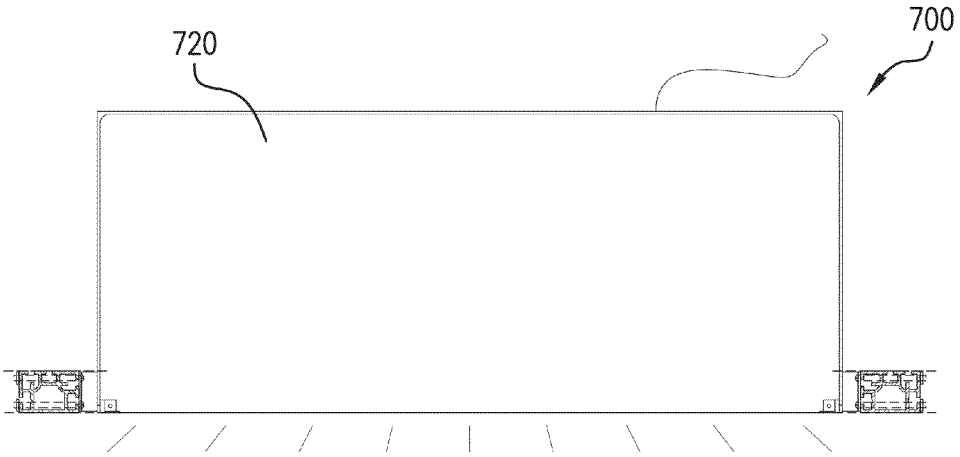
FIG. 22 illustrates a cross-sectional transverse view of a section of a trough including a subwoofer according to an embodiment presented herein.
Figure 23:
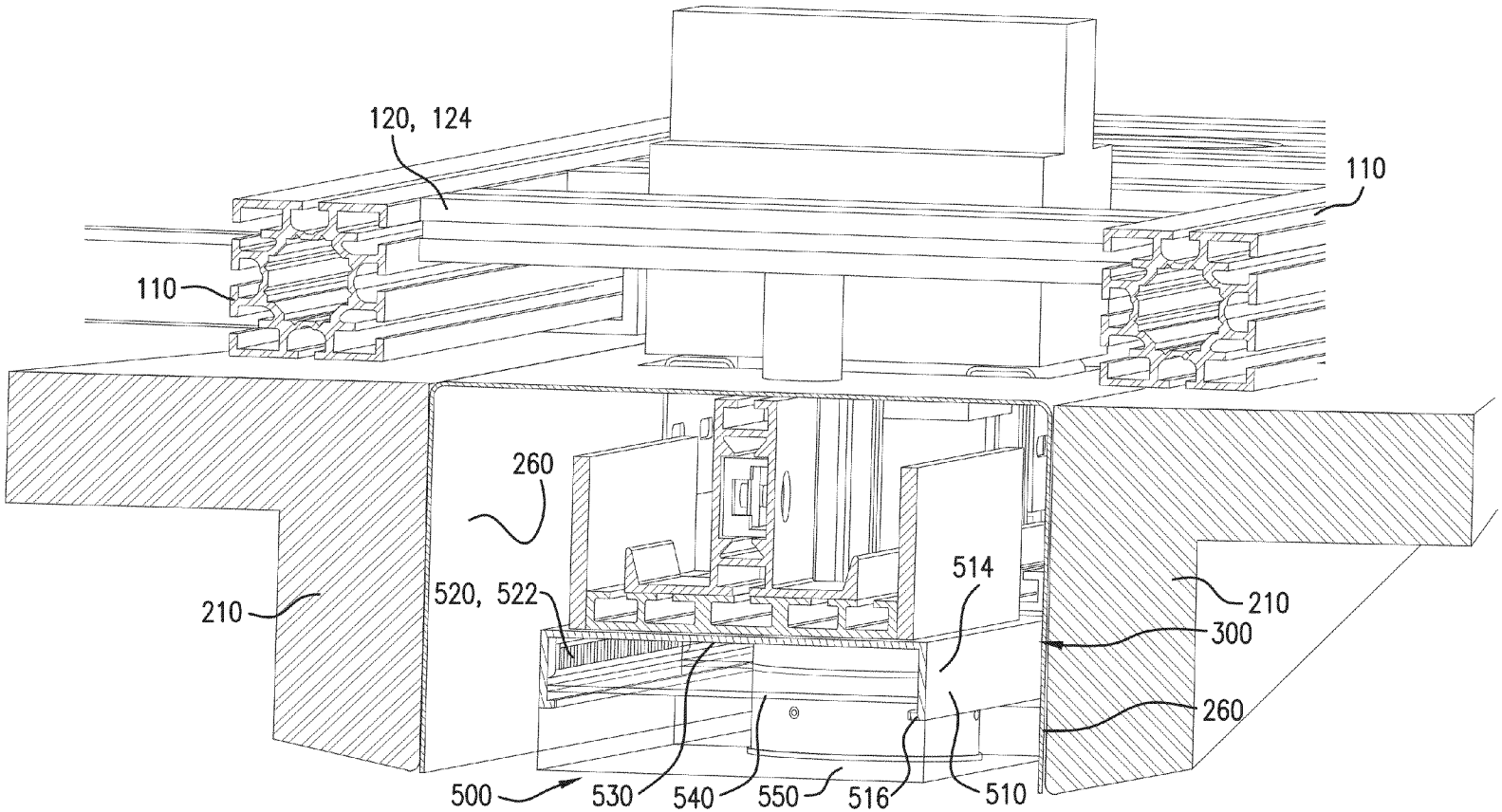
FIG. 23 illustrates a perspective view of a section of a trough including a linear trough light according to an embodiment presented herein.

To further achieve high sound quality, in some embodiments sound system 700 may include a subwoofer 720, which may also be disposed within trough area 114 (see FIGS. 21 and 23). Subwoofer 720 may be mounted to support structure 100 above trough 300, and may output sound downward between upper covers 330 and around central cover 320 as shown by arrows 750 in FIG. 21. Subwoofer 720 may also be no more than 6 inches wide, to effectively fit within trough area 114.

In some embodiments, rather than having a cover plate in trough 300, trough 300 includes a linear trough light 500, as shown, for example, in FIGS. 2 and 23-39. As shown in FIG. 2, linear trough light 500 can occupy the majority, or substantially all, of the lower portion of trough 300. Linear trough light 500 provides light to room 20 in which it is installed as part of ceiling system 10. Linear trough light 500 can be used with lighted panels 202 or non-lighted panels 204. Linear trough light 500 provides particularly beneficial illumination when used with non-lighted panels 204, since non-lighted panels 204 do not produce light and therefore do not substantially contribute to illuminating room 20.

Figure 24:
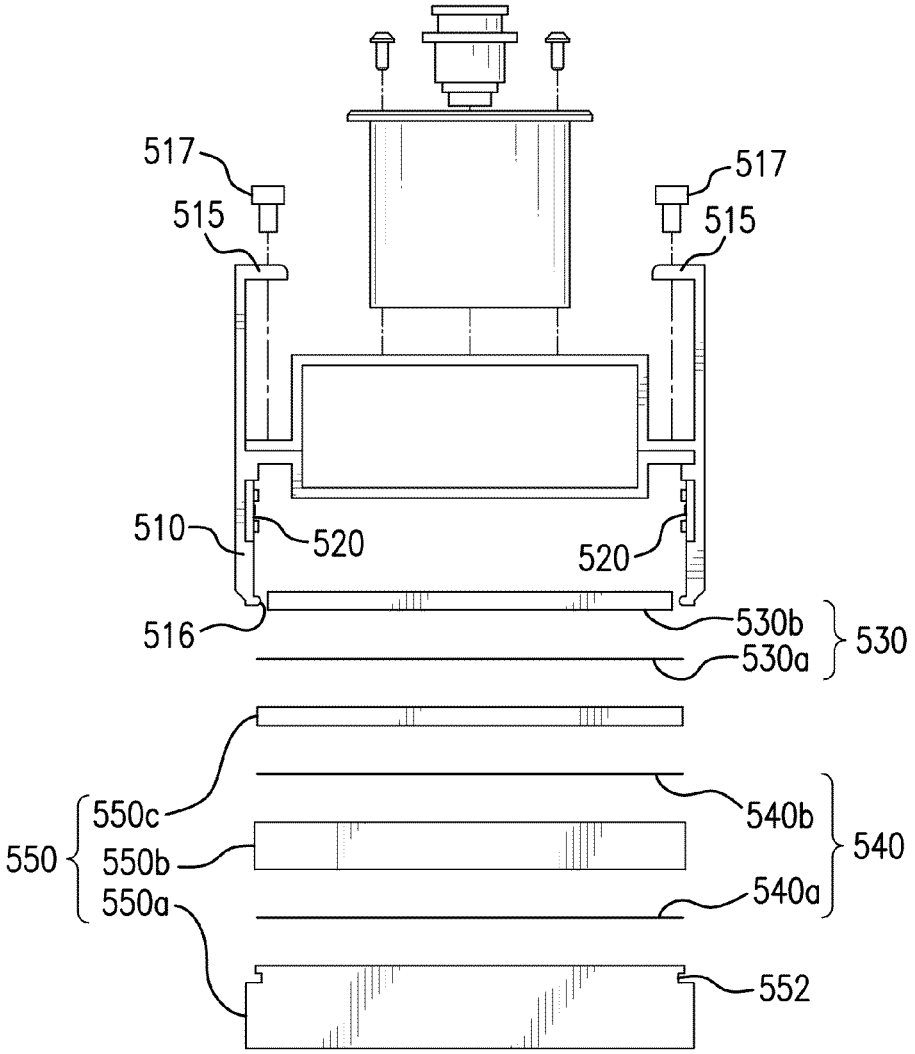
FIG. 24 illustrates a cross-sectional end view of a section of a trough including a linear trough light according to an embodiment presented herein.
Figure 25:
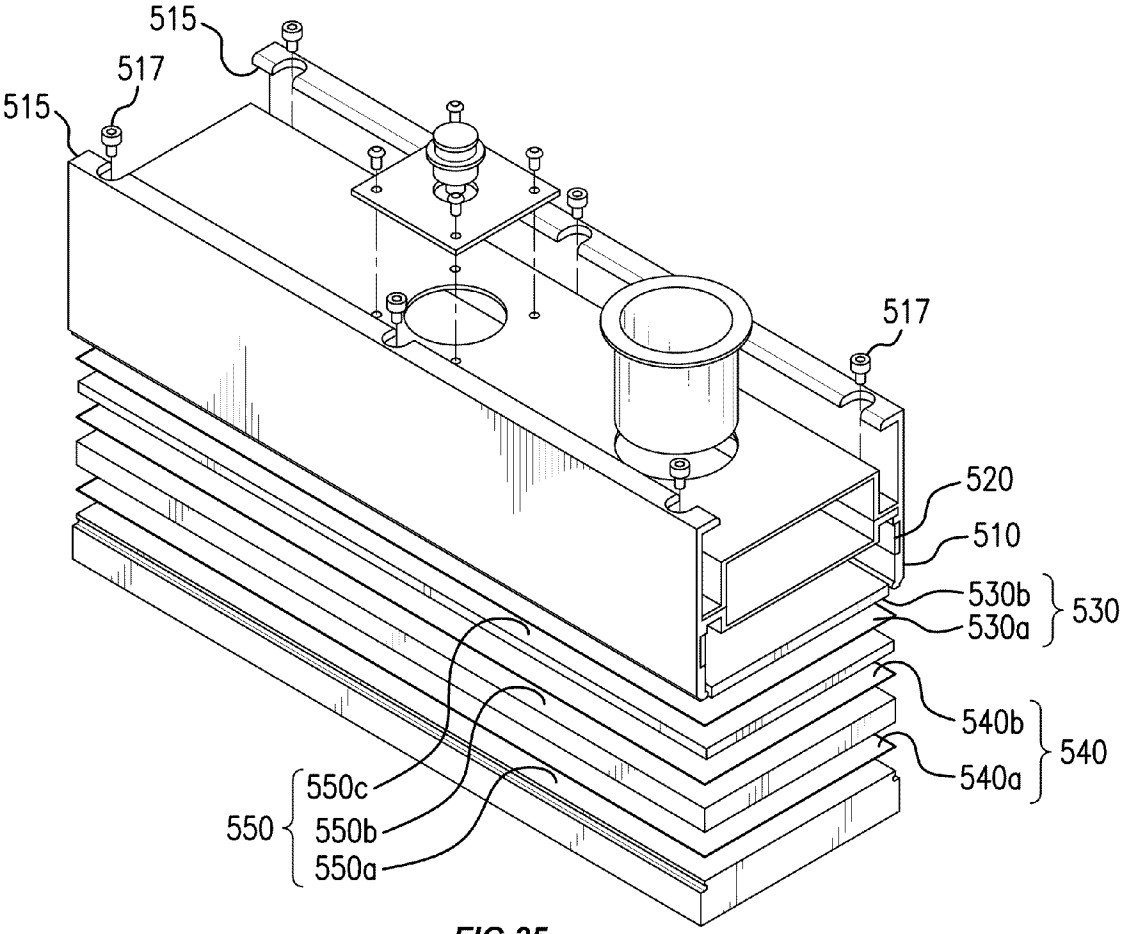
FIG. 25 illustrates a perspective view of a section of a trough including a linear trough light according to an embodiment presented herein.

FIG. 23 shows a perspective cross-sectional view of trough 300 containing an embodiment of linear trough light 500. FIGS. 24 and 25 show exploded views of trough 300 containing another embodiment of linear trough light 500. Linear trough light 500 may include a frame 510, a light source 520, a backing layer 530, a diffusing layer 540, and a lens 550.

In some embodiments, frame 510 forms an inverted "U" shape having a horizontal upper section 512 and two vertical sides 514. Vertical sides 514 may include inwardly-extending flanges 512 along their edges.

Figure 28:
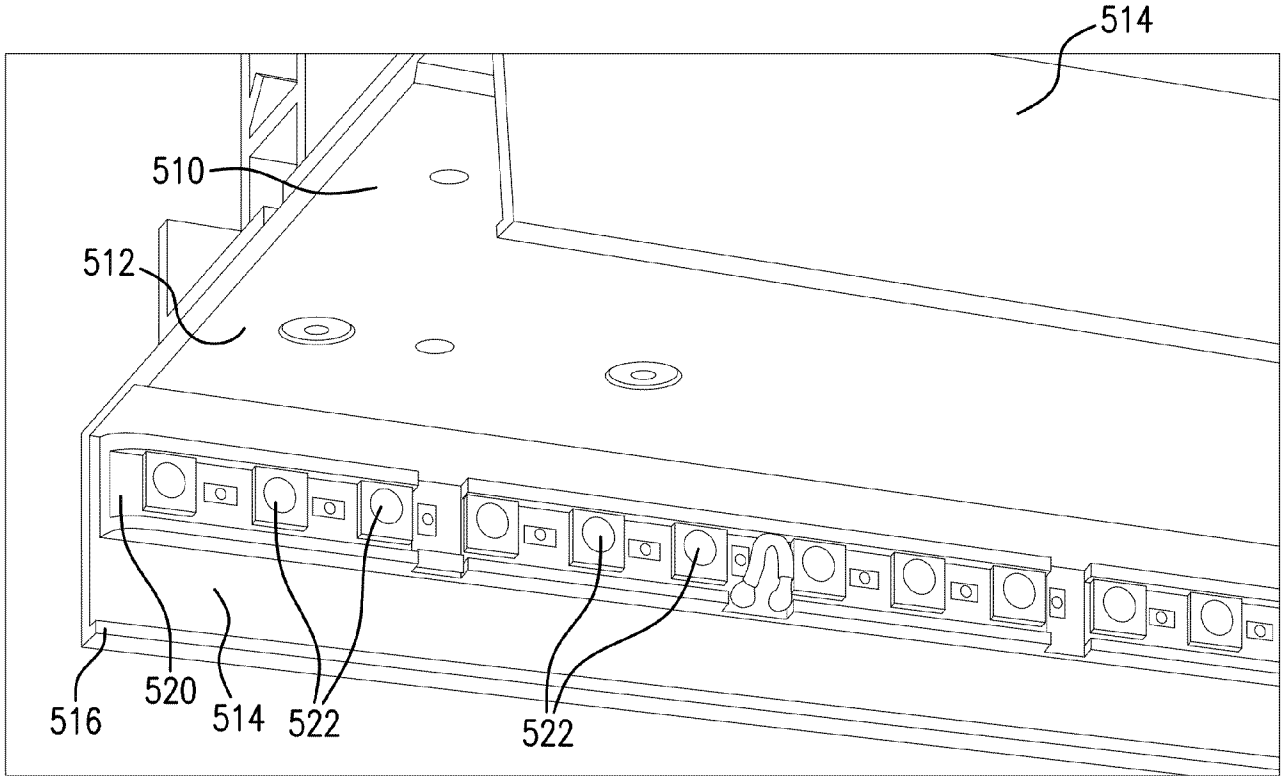
FIG. 28 illustrates a perspective view of a frame of a linear trough light according to an embodiment presented herein.

A light source 520 may be disposed on the inner sides of one or both of sides 514. In some embodiments, light source 520 includes a plurality of LEDs, which may take the form of a strip of side-firing LEDs 522 as shown in FIG. 28, which shows frame 510 alone. LEDs 522 may be oriented to emit light horizontally toward a longitudinal center of frame 510.

Figure 26:
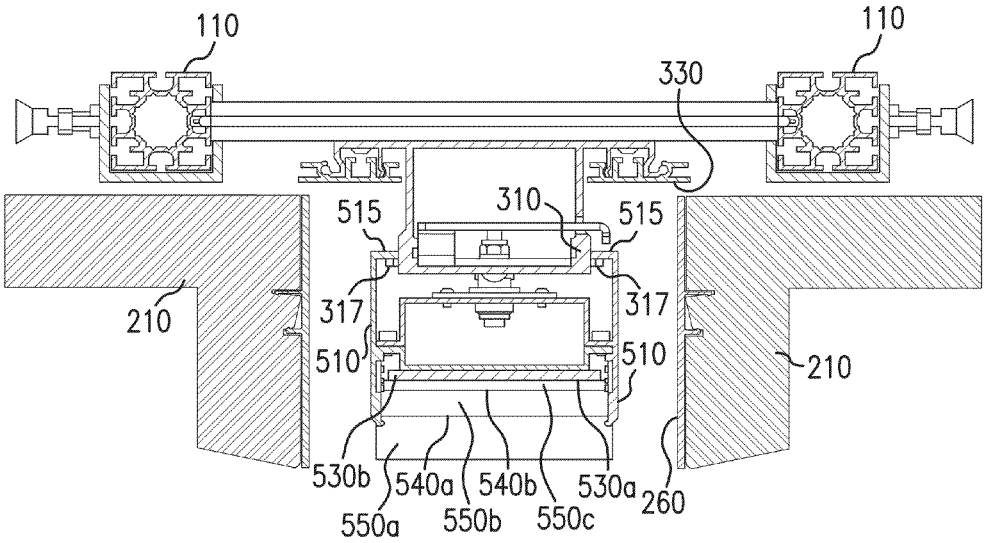
FIG. 26 illustrates a cross-sectional transverse view of a section of a trough including a linear trough light according to an embodiment presented herein.
Figure 27:
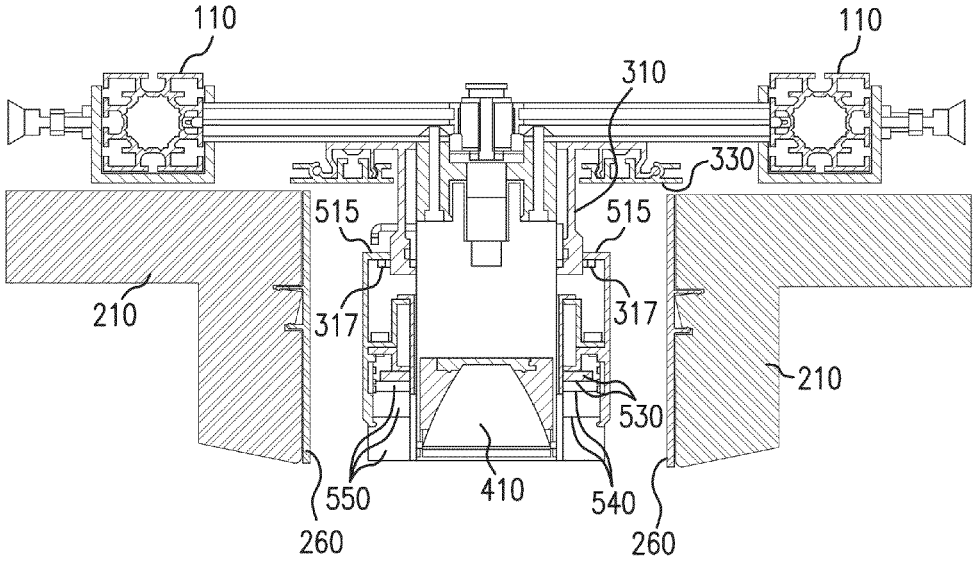
FIG. 27 illustrates a cross-sectional transverse view of a section of a trough including a linear trough light and a downlight according to an embodiment presented herein.

Frame 510 may be coupled to trough area transverse struts 124 to thereby retain frame 510 within trough 300. Frame 510 may interconnect with other elements of linear trough light 500 to retain them within trough 300 as well (see FIGS. 23-27). In some embodiments frame 510 is configured to snap onto T-bar 310 similarly as described above for central cover 320. In some embodiments frame 510 attaches to T-bar 310 differently from central cover 320, but using features of cover attachment mechanism 312. For example, frame 510 may be bolted to T-bar 310 using bolts that are received by the cavities that would otherwise contain spring-loaded ball bearings 318. In some embodiments frame 510 attaches to transverse struts 124 without using T-bar 310, but with an alternate bracket arrangement (see, e.g., FIGS. 23-27 and 30). As shown in FIGS. 26 and 27 for example, frame 510 may include upper flanges 515 that are supported by protrusions 317 extending outward from sides of T-bar 310. Upper flanges 515 may be fastened to protrusions 317 by any suitable fastener such as, for example, bolts 517 as shown in FIGS. 23 and 24.

Figure 29:
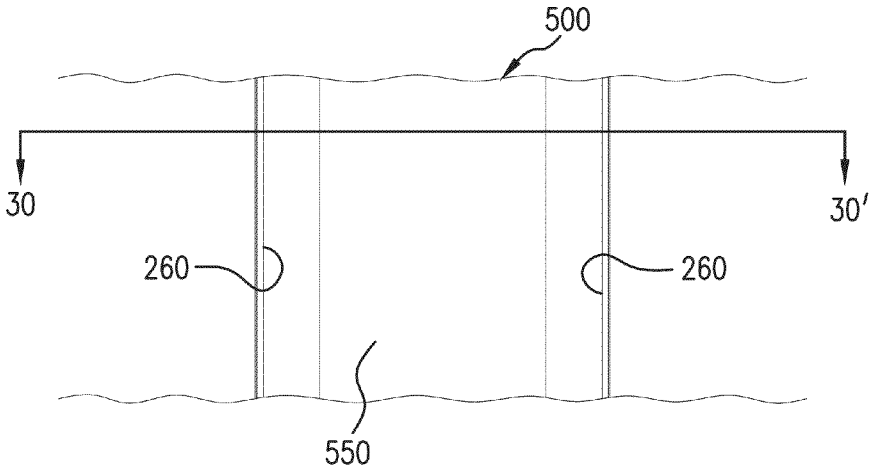
FIG. 29 illustrates a bottom view of a section of a trough including a linear trough light according to an embodiment presented herein.
Figure 30:
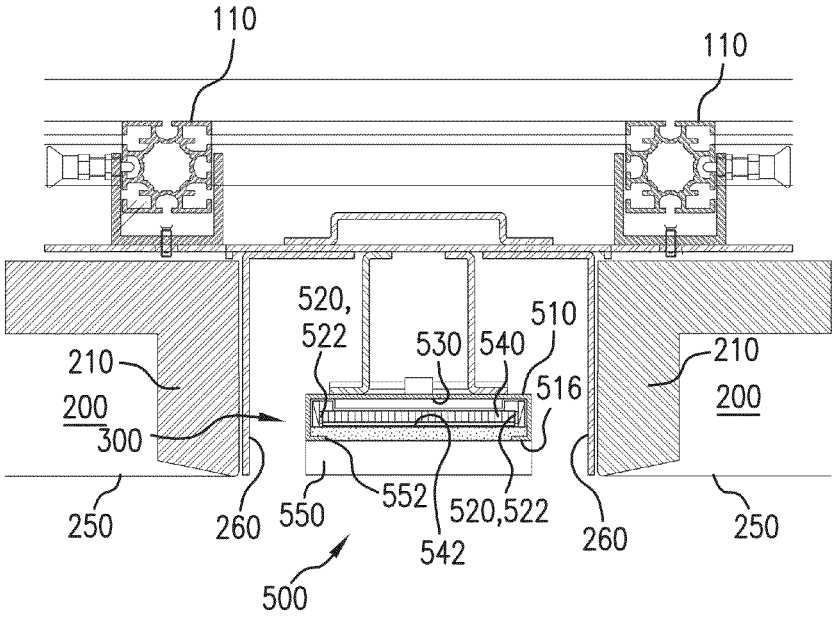
FIG. 30 illustrates a cross-sectional view taken along line 30-30' of FIG. 29.

FIG. 29 shows a bottom view of a portion of linear trough light 500 having no penetration therethrough. FIG. 30 shows a cross-sectional view of trough 300 taken across line 27-27' of FIG. 29. In some embodiments, the lowest lens 550 (e.g., lens **550*a*, see FIGS. 24 and 25) includes grooves 552 along sides thereof. Grooves 552 may receive lower flanges 516 of frame 510 to thereby couple lens 550 to frame 510. Other elements of linear trough light 500 can be disposed above and retained by the lowest lens 550 coupled to frame 510. In some embodiments linear trough light 500 may include a single diffusing layer 540, as shown in FIG. 23, and in some embodiments linear trough light 500 may include may include multiple diffusing layers 540, such as, for example, first diffusing layer 540*a* and second diffusing layer 540*b*, as shown in FIGS. 24 and 25. In some embodiments linear trough light 500 may include a single lens 550, as shown in FIG. 23, and in some embodiments linear trough light 500 may include multiple lenses 550, such as, for example, first lens layer 550***a*, second lens layer 550*b*, and third lens layer 550*c*, as shown in FIGS. 24 and 25. Diffusing layers 540 may be retained by being positioned above lenses 550 and resting thereon. Backing layers 530 may also be retained by being positioned above lenses 550 and resting thereon, or may be applied directly to the bottom surface of upper section 512 of frame 510.

One or more diffusing layers 540 may be positioned in alignment with LEDs 522, such that light emitted by LEDs 522 is received by diffusing layer 540. Diffusing layer 540 may be formed of one or more layers of a clear acrylic having a pattern 542 applied thereon or formed therein that diffuses the light received and directs it downward toward lens 550. Some light may also be directed upward toward backing layer 530, which may have a reflective surface to as to reflect incident light downward toward lens 550, where it is output to room 20. To help reflect light, and to help provide a consistent look throughout linear trough light 500, backing layer 530 may be white. In some embodiments backing layer 530 may be a single layer, as shown in FIG. 23, and in some embodiments backing layer 530 may be composed of multiple layers, such as, for example, first backing layer 530*a* and second backing layer 530*b*, as shown in FIGS. 24 and 25. First backing layer 530*a* may have a reflective lower surface to reflect light as described above. Second backing layer 530*b* may be a cushioning layer to brace and provide positive contact between backing layer 530 and frame 510. Second backing layer 530*b* may be formed of, for example, foam.

To evenly draw in and diffuse light from LEDs 522, diffusing layers 540 (e.g., first diffusing layer 540*a* and second diffusing layer 540*b*) may be spaced apart from each other, as shown, for example, in FIGS. 24 and 25. Lens layers 550 (e.g., second lens layer 550*b* and third lens layer 550*c*) may be disposed between diffusing layers 540 to maintain spacing of diffusing layers 540 and to facilitate the passage of light.

To avoid interfering with light passing therethrough, lens 550 may be formed of a clear material, for example, acrylic, for example, heat polished acrylic, for example, Polymethyl methacrylate (PMMA).

A pattern 542 may be formed on or in one or more layers of diffusing layer 540 by etching (e.g., laser etching), or may be stamped upon one or more layers of diffusing layer 540 by a mold (e.g., a metal mold with pressure and heat applied). To promote uniform light diffusion throughout diffusing layer 540, pattern 542 may become more dense (i.e., spacing between pattern features may decrease) as its distance from LEDs 522 increases. For example, in an embodiment with LEDs 522 along both sides of frame 510, pattern 542 may be formed of spaced-apart longitudinal lines etched or otherwise applied to diffusing layer 540. The space between adjacent lines may decrease (i.e., the pattern may become more dense) as they approach the center of diffusing layer 540.

Figure 31:
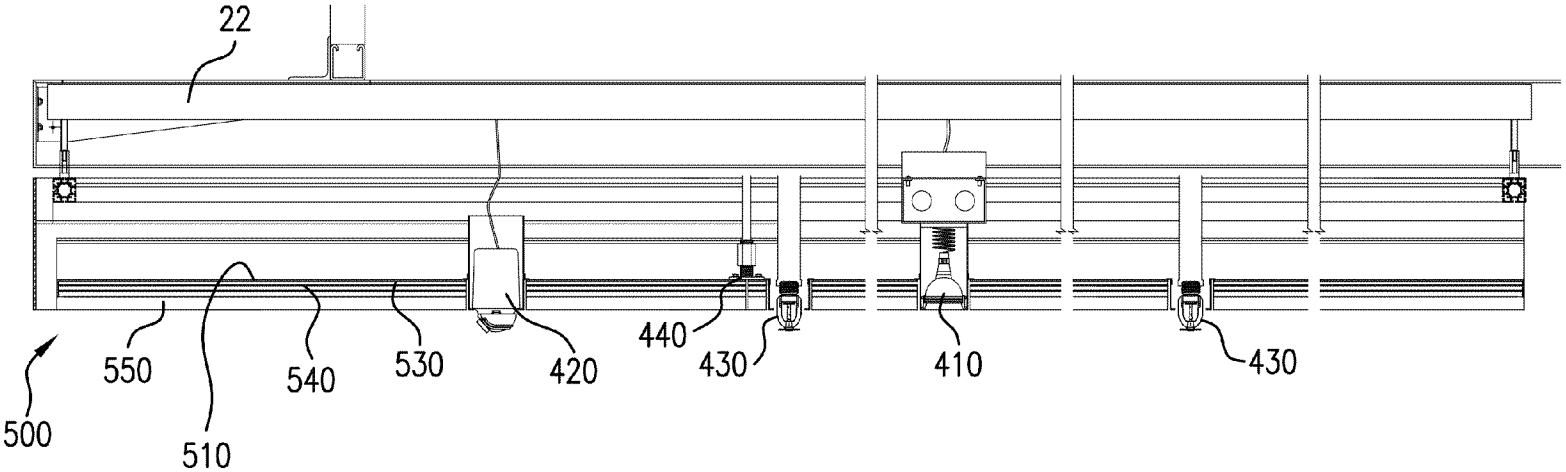
FIG. 31 illustrates a cross-sectional transverse view of a trough according to an embodiment presented herein.

Penetrations 400 may extend through linear light trough 500 in a similar manner as they may extend through central cover 320, described above. FIG. 31 shows a cross-sectional view taken across a longitudinal line extending through an exemplary linear light trough 500. As shown, penetrations 400 may include, for example, downlight 410, camera 420, sprinkler 430, and smoke detector 440.

Figure 32:
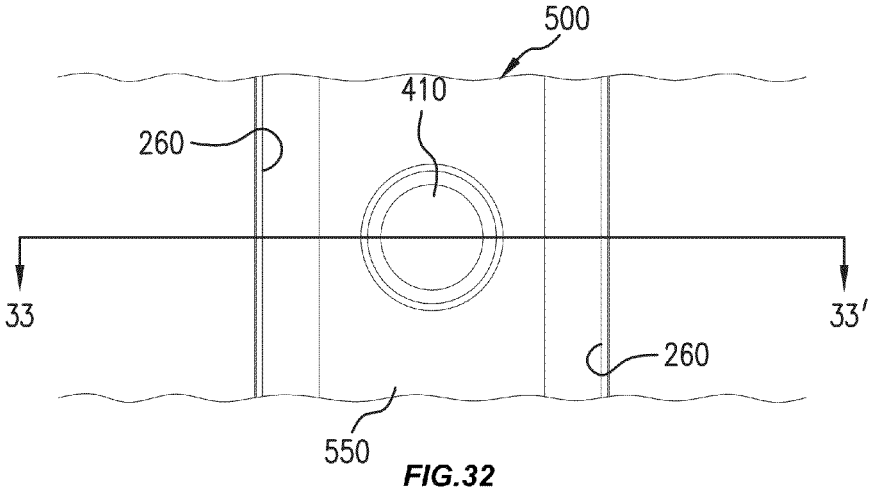
FIG. 32 illustrates a bottom view of a section of a trough including a linear trough light and a downlight according to an embodiment presented herein.
Figure 33:
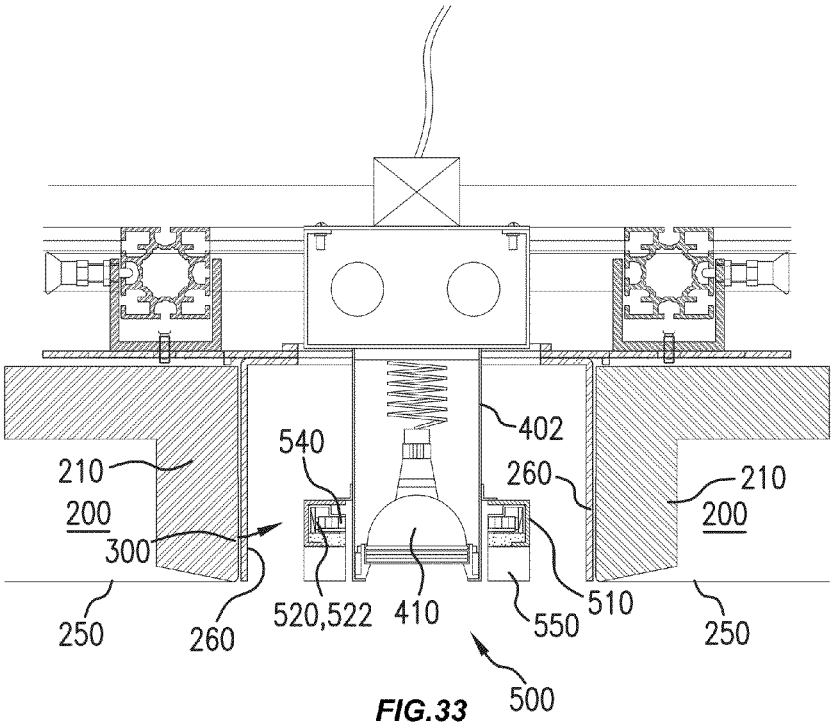
FIG. 33 illustrates a cross-sectional view taken along line 33-33' of FIG. 32.
Figure 34:
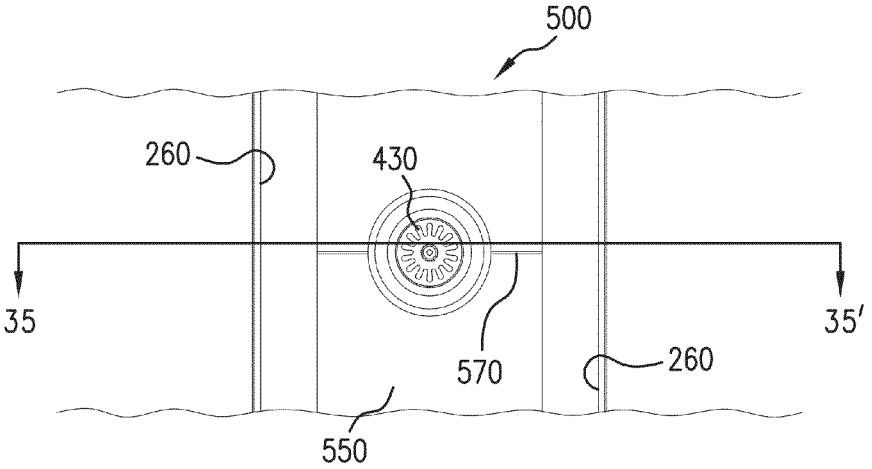
FIG. 34 illustrates a bottom view of a section of a trough including a linear trough light and a sprinkler according to an embodiment presented herein.
Figure 35:
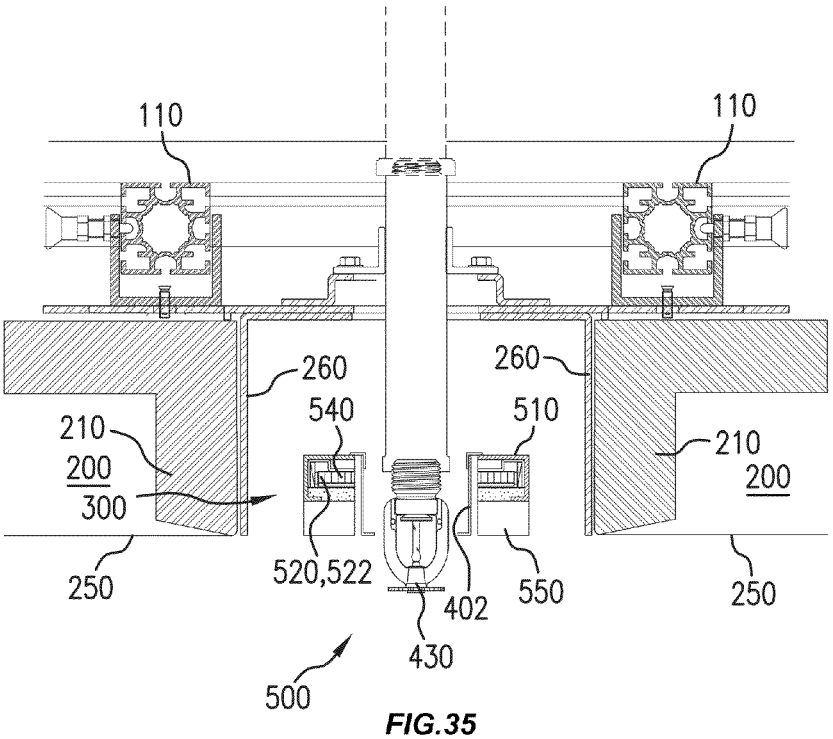
FIG. 35 illustrates a cross-sectional view taken along line 35-35' of FIG. 34.
Figure 36:
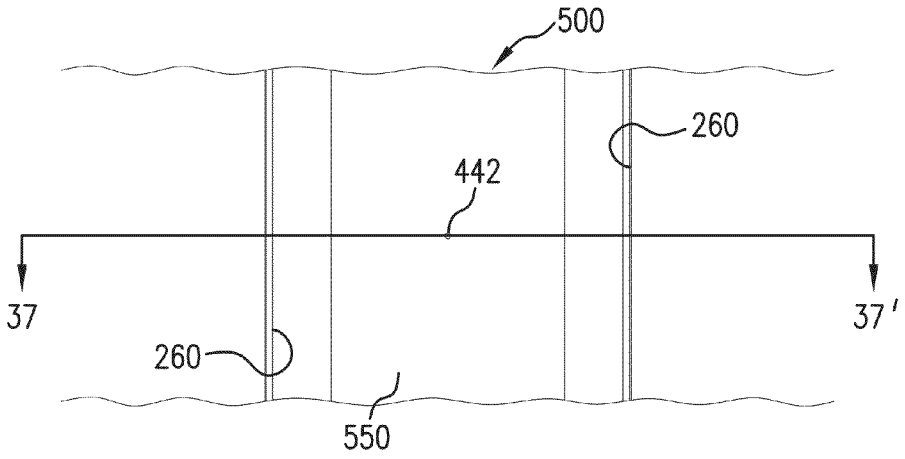
FIG. 36 illustrates a bottom view of a section of a trough including a linear trough light and a smoke detector according to an embodiment presented herein.
Figure 37:
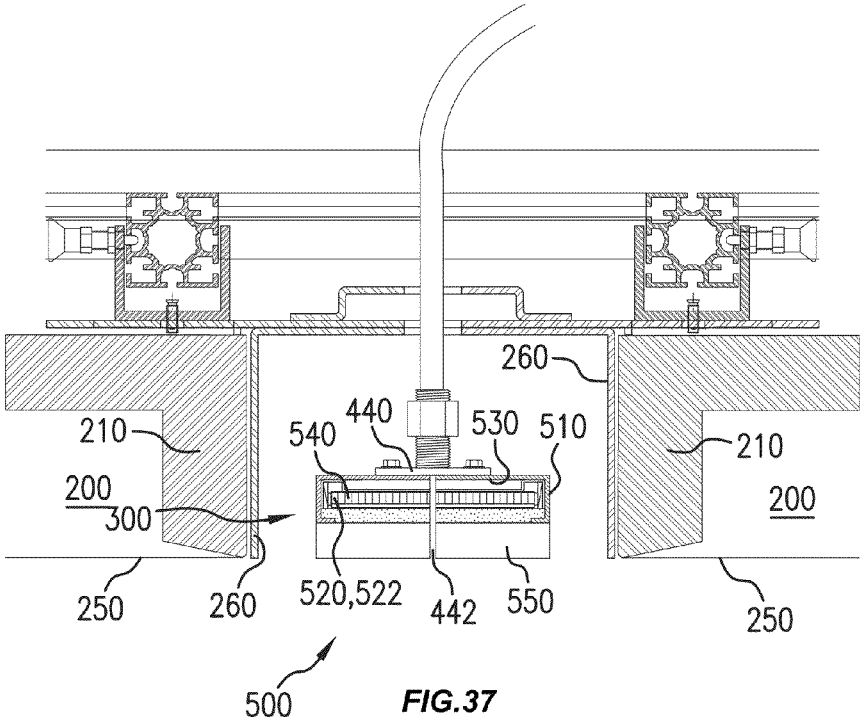
FIG. 37 illustrates a cross-sectional view taken along line 37-37' of FIG. 36.
Figure 38:
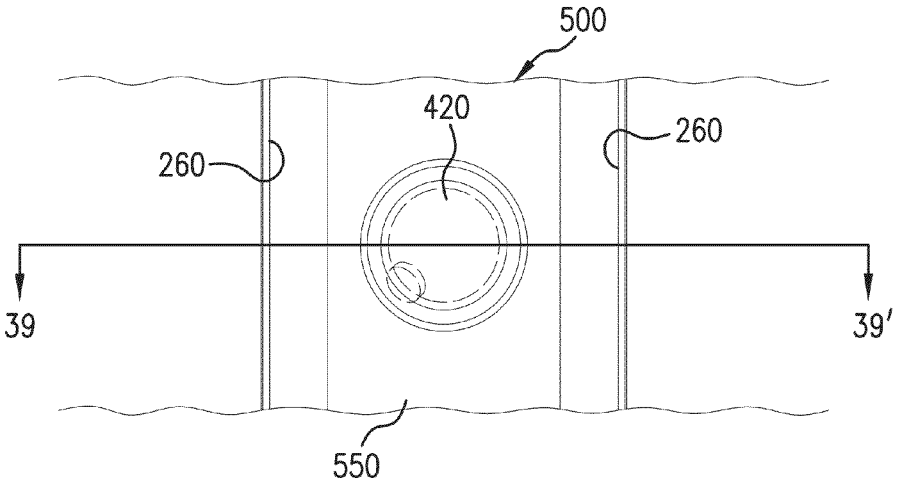
FIG. 38 illustrates a bottom view of a section of a trough including a linear trough light and a camera according to an embodiment presented herein.
Figure 39:
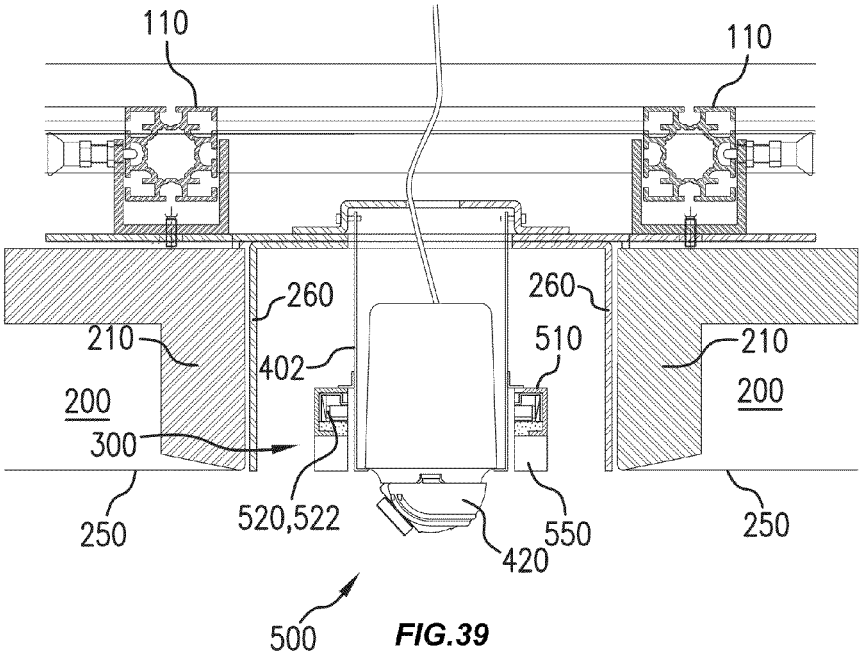
FIG. 39 illustrates a cross-sectional view taken along line 39-39' of FIG. 38.

FIG. 32 shows a bottom view of a portion of linear trough light 500 having downlight 410 penetrating therethrough. FIG. 33 shows a cross-sectional view of trough 300 taken across line 30-30' of FIG. 32. FIGS. 34 and 35 similarly show a portion of linear trough light 500 having sprinkler 430 penetrating therethrough, FIGS. 36 and 37 similarly show a portion of linear trough light 500 having smoke detector opening 442 penetrating therethrough, FIGS. 38 and 39 similarly show a portion of linear trough light 500 having camera 420 penetrating therethrough.

As shown, penetration sleeve 402 may surround penetration 400 (e.g., downlight 410, camera 420, and sprinkler 430) to protect and hide its internal structure, as described above. Some penetrations 400 (e.g., downlight 410 and camera 420) may be coupled to and supported by their penetration sleeves 402. Others (e.g., sprinkler 430) may extend through their penetration sleeves 402 without contacting their penetration sleeves 402. For some penetrations 400 (e.g., smoke detector 440), no penetration sleeve is used. In the case of smoke detector 440, no penetration sleeve is needed since smoke detector 440 can detect smoke from above linear trough light 500 through a smoke detector opening 442 through linear trough light 500.

Penetration sleeve 402, and penetration 400 contained therein, may extend through an opening 518 in upper section 512 of frame 510, and may further extend through corresponding openings in backing layer 520, diffusing layer 540, and lens 550 of linear trough light 500. A bottom edge or surface of penetration sleeve 402 may extend to and align with the bottom surface of lens 550, in order to present a consistent visual impression.

Providing penetrations 400 within trough 300 allows them to perform their functions without interfering with the visual impression of panels 200. Their alignment and consistent structure and appearance (e.g., from penetration sleeves 402) within trough 300 provides an ordered and consistent appearance between panels 200.

A plurality of linear trough light segments 500 may be arranged end-to-end within trough 300. Breaks 570 between adjacent linear trough light segments 500 may create a visual interruption (see FIG. 34). Breaks 570 can be arranged at penetrations 400, or can be arranged between penetrations. Positioning breaks 570 between penetrations avoids increasing the visual effect of the interruption, since the appearance and color of penetrations 400 may be drawn into the abutting ends of lenses 550, thereby making breaks 570 more visible.

Figure 40:
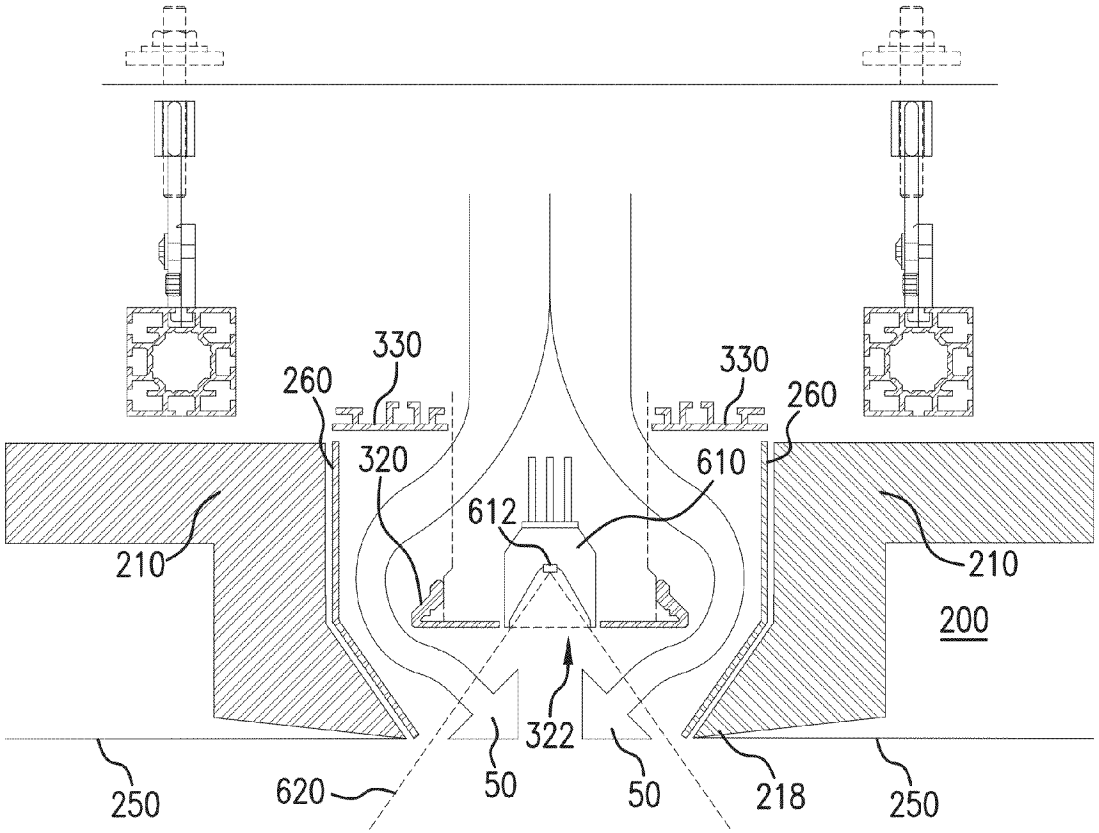
FIG. 40 illustrates a cross-sectional longitudinal view of a trough including a recessed light according to an embodiment presented herein.

In some embodiments, to minimize the visual impact of trough 300, bottom edges 218 of frame 210 may be angled outward, into trough area 300, as shown in FIG. 40. In this way panels 200 appear closer from below and troughs 300 appear narrower from below. Such embodiments may still include central cover 320 attached to T-Bar 310 as described above. To minimize the visual impact of light sources within trough 300, such light sources may be recessed from bottom edges 218, and may be aligned with or recessed from central cover 320.

As shown in FIG. 40, a recessed light 610 has a light source 612 disposed centrally therein. Light source 612 may emit light through an opening 322 in central cover 320. Light source 612 may be recessed from opening 322 as shown in FIG. 40. In this configuration, light emitted by light source 612 will form a cone shape 620. To avoid loss of or interference with light emitted from light source 612 through opening 322, ceiling system 10 may be configured such that panels 200 are spaced apart enough so that they do not extend within light cone 620. In other words, light source 612, opening 322, and panel frame 210 may be arranged such that no imaginary line extending through light source 612 and an edge of opening 322 intersects an adjacent panel 200 (or any element of ceiling system 10 below central cover 320.

Avoiding interference with light cone 620 and other elements of ceiling system 10 can help to avoid creating distracting shadows and hard edges to the light provided by recessed light 610. A light fixture such as recessed light 610 may be preferable to downlight 410 in some ceiling system 10 installations. For example, recessed light 610 may better illuminate a room 20 having a lower ceiling, while downlight 410 may better illuminate a room 20 having a higher ceiling.

As described above, panels 200 may be large, having continuous elements such as fabric 252 extending their length and width. To install such a large panel 200 in a ceiling area 26 of a room 20, support structure 100 may include hoisting mechanisms that may be used to hoist panels 200. The hoisting mechanisms may be mounted to longitudinal supports 110 so as not to be visible from below. Hoisting cables may extend from hoisting mechanisms to connect to a panel 200 to be hoisted.

Panel 200 may be constructed before installation within ceiling 28. For example, fabric 252 may be laid out on a floor and frame 210 of panel 200 may be constructed on the floor (e.g., on fabric 252) below its intended location in ceiling 28. After frame 252 is constructed, fabric 252 may be tensioned over frame 210 and attached thereto. A light source 240 may also be incorporated into panels 200 during construction. Hoisting cables may be fixed to frame 210 of panel 200. Once panel 200 is constructed and hoisting cables are secured to frame 210, panel 200 is ready to be hoisted into place.

For large-scale panels 200, construction outside the ceiling area 26 (e.g., on the floor below) simplifies construction as opposed to in-ceiling construction, since workers do not have to worry about suspending the elements of panel 200 while constructing it.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not exhaustive and do not limit the embodiments to the precise forms disclosed. It will be apparent to one of ordinary skill in the art that many modifications and variations are possible in view of the above teachings.

For example, although the ceiling system of the present invention has been described with reference to a ceiling, its principles apply to other building features structures such as walls, floors, and roofs.

The elements of the embodiments presented above are not necessarily mutually exclusive, but may be interchanged to meet various needs as would be appreciated by one of skill in the art. The breadth and scope of the present invention should not be limited by any of the above-described exemplary embodiments, but should be defined only in accordance with the following claims and their equivalents.

What is claimed is:

1. A ceiling system for a room, the system comprising:

a plurality of panels each having a length extending from one side of the room to an opposite side of the room, wherein the panels extend parallel to each other and are spaced apart from each other to define a trough between adjacent panels; and an elongated light fixture disposed within the trough and extending from one end of the trough to an opposite end of the trough, wherein the elongated light fixture defines a plurality of opening therethrough; and a plurality of penetrations extending through the openings, wherein the panels and at least one of the elongated light fixture together define a ceiling of the room.

2. The system of claim 1, wherein a first distance between a panel and a first wall at the one side of the room is less than the length of the panel, and wherein a second distance between the panel and a second wall at the opposite side of the room is less than the length of the panel.

3. The system of claim 1, wherein a first distance between a panel and a first wall at the one side of the room is less than a width of the panel, and wherein a second distance between the panel and a second wall at the opposite side of the room is less than a width of the panel.

4. The system of claim 1, wherein a perimeter of the ceiling is disposed adjacent walls of the room, and wherein a distance between the perimeter and the walls is no greater than 5% of the length of the panel.

5. The system of claim 1, wherein a perimeter of the ceiling is disposed adjacent walls of the room, and wherein a distance between the perimeter and the walls is no greater than 10% of the width of the panel.

6. The system of claim 1, wherein a perimeter of the ceiling is disposed adjacent walls of the room, and wherein a distance between the perimeter and the walls is between 3 inches and 36 inches.

7. The system of claim 1, wherein the plurality of panels and the elongated light fixture extend to an end of the room at the one side of the room and to an end of the room at the opposite side of the room.

8. The system of claim 1, wherein the length of each of the plurality of panels is no less than 32 feet.

9. The system of claim 1, wherein the length of each of the plurality of panels is at least 500% of its width.

10. The system of claim 1, wherein the panels comprise a light source.

11. The system of claim 1, wherein the panels do not comprise a light source.

12. The system of claim 1, wherein a lower-most lens surface of the elongated light fixture is in vertical alignment with a lower-most surface of adjacent panels.

13. The system of claim 1, wherein the elongated light fixture extends throughout at least 90% of the length of the trough.

14. The system of claim 1, wherein the elongated light fixture extends throughout at least 90% of the width of the trough.

15. The system of claim 1, wherein the plurality of penetrations comprises at least one of a downlight, a camera, and a sprinkler.

16. The system of claim 1, wherein each panel comprises:

a panel frame; and a continuous cover tensioned over the frame and extending continuously along the length of the panel.

17. The system of claim 16, wherein the cover is a flexible sheet material.

18. The system of claim 16, wherein the cover is a glass fiber fabric.

19. The system of claim 16, wherein the length of each of the plurality of panels is no less than 32 feet, and wherein the cover is a glass fiber fabric.

20. The system of claim 1, wherein the elongated light fixture comprises:

a series of light-emitting diodes (LEDs);

a diffusing layer that diffuses light from the LEDs;

a lens layer disposed below the diffusing layer, wherein light from the LEDs is emitted from the elongated light fixture through the lens layer.

21. The system of claim 1, wherein sides of the trough are defined by side covers, and wherein the side covers are parallel with sides of the elongated light fixture.

22. The system of claim 1, wherein the elongated light fixture comprises a plurality of elongated light sub-elements abutted end-to-end within the trough.

23. A ceiling system for a room, the system comprising:

a plurality of panels each having a length extending from one side of the room to an opposite side of the room, wherein the panels extend parallel to each other and are spaced apart from each other to define a trough between adjacent panels; and an elongated light fixture disposed within the trough and extending from one end of the trough to an opposite end of the trough, wherein the panels and at least one of the elongated light fixture together define a ceiling of the room, wherein the elongated light fixture comprises a plurality of elongated light sub-elements abutted end-to-end within the trough, wherein the elongated light sub-elements define openings therethrough, and wherein the elongated light sub-elements abut between the openings.

24. An elongated light fixture comprising:

a frame having opposing vertically-arranged walls;

at least one series of LEDs disposed on an interior side of at least one of the opposing vertically-arranged walls;

a diffusing layer disposed between the frame walls, wherein the diffusing layer is configured to diffuse light from the LEDs;

a backing layer disposed above the diffusing layer, wherein the backing layer is configured to reflect light from the LEDs; and a lens layer disposed below the diffusing layer, wherein the lens layer is configured to transmit light from the LEDs.

25. The fixture of claim 24, comprising a plurality of diffusing layers, wherein at least two of the plurality of diffusing layers are spaced vertically apart with the lens layer disposed therebetween.

26. The fixture of claim 25, comprising a plurality of lens layers, wherein at least two of the plurality of lens layers are spaced vertically apart with at least one of the plurality of diffusing layers disposed therebetween.

27. The fixture of claim 24, wherein the lens layer is formed of solid clear acrylic.

28. The fixture of claim 24, wherein the lens layer defines grooves extending along opposing sides thereof;

wherein each wall has an inwardly-extending flange at the end thereof that extends into one of the grooves of the lens layer to couple the lens layer to the frame.

29. The fixture of claim 24, wherein the diffusing layer comprises a diffusing pattern integrally formed therein, wherein density of the diffusing pattern increases in the diffusing layer as distance from the LEDs increases.

30. The fixture of claim 24, comprising at least two series of LEDs, each disposed on an opposing interior side of the opposing vertically-arranged walls.

31. A ceiling system for a room, the system comprising:

a plurality of longitudinal supports extending parallel to each other, wherein the longitudinal supports are disposed in a ceiling area of the room;

a plurality of lighted panels extending parallel to each other and spaced apart from each other to define a trough between adjacent lighted panels, wherein each lighted panel is disposed between at least two of the longitudinal supports;

an elongated light fixture disposed within the trough; and a plurality of penetrations disposed within the trough and extending through openings in a lens of the elongated light fixture.

32. The system of claim 31, wherein the plurality of penetrations comprises at least one of a downlight, a camera, a sprinkler, and a smoke detector.

33. The system of claim 31, wherein each lighted panel comprises:

a panel frame coupled to the at least two longitudinal supports;

a continuous fabric cover tensioned over the frame; and a lighting element disposed above the fabric cover.

34. A ceiling system for a room, the system comprising:

a plurality of panels extending parallel to each other, wherein the panels are spaced apart from each other to define a trough between adjacent panels; and an elongated light fixture disposed within the trough, wherein the elongated light fixture comprises a plurality of elongated light sub-elements abutted end-to-end within the trough, wherein the elongated light sub-elements define openings therethrough.

35. The system of claim 34, wherein the elongated light sub-elements abut between the openings.

* * * * *